US012546572B2

(12) United States Patent
Gish et al.

(10) Patent No.: US 12,546,572 B2
(45) Date of Patent: Feb. 10, 2026

(54) DISTRIBUTING DEPLOYMENTS IN A CONDUCTED ELECTRICAL WEAPON

(71) Applicant: Axon Enterprise, Inc., Scottsdale, AZ (US)

(72) Inventors: Michael E. Gish, Scottsdale, AZ (US); Magne H. Nerheim, Paradise Valley, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 112 days.

(21) Appl. No.: 18/222,867

(22) Filed: Jul. 17, 2023

(65) Prior Publication Data

US 2024/0027172 A1 Jan. 25, 2024

Related U.S. Application Data

(60) Provisional application No. 63/391,445, filed on Jul. 22, 2022.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025
USPC ..... 42/1.08; 361/232
See application file for complete search history.

(56) References Cited

U.S. PATENT DOCUMENTS

| | | | |
|---|---|---|---|
| 8,020,481 | B1 | 9/2011 | Beckwith |
| 10,982,920 | B1 | 4/2021 | Bailey |
| 2007/0081293 | A1 | 4/2007 | Brundula et al. |
| 2020/0109924 | A1 | 4/2020 | Goodchild et al. |
| 2021/0080231 | A1 | 3/2021 | Nerheim |
| 2021/0364256 | A1 | 11/2021 | Pirc et al. |

FOREIGN PATENT DOCUMENTS

| | | | |
|---|---|---|---|
| CN | 101410689 | A | 4/2009 |
| TW | 202206775 | A | 2/2022 |
| TW | 202227774 | A | 7/2022 |
| WO | 2021101604 | A1 | 5/2021 |
| WO | 2021188001 | A1 | 9/2021 |

OTHER PUBLICATIONS

International Searching Authority, International Search Report for International Application No. PCT/US2023/027925 mailed Nov. 9, 2023.

Taiwan Patent Office, Office Action for Taiwanese Application No. 112127134 mailed Mar. 22, 2024.

*Primary Examiner* — Reginald S Tillman, Jr.

(74) *Attorney, Agent, or Firm* — Justin Powley

(57) ABSTRACT

A conducted electrical weapon ("CEW") may distribute deployments from the CEW across a same activation event and across different activation events. The system may distribute deployments based on a deployment list. The deployment list may define a sequential deployment order for a deployment connections of the CEW. The system may determine a next deployment connection and activate the next deployment connection based on the deployment list. The system may update the deployment list responsive to activations of deployment connections such that the deployment list is sequentially maintained between activation events.

20 Claims, 8 Drawing Sheets

DISTRIBUTING DEPLOYMENTS IN A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
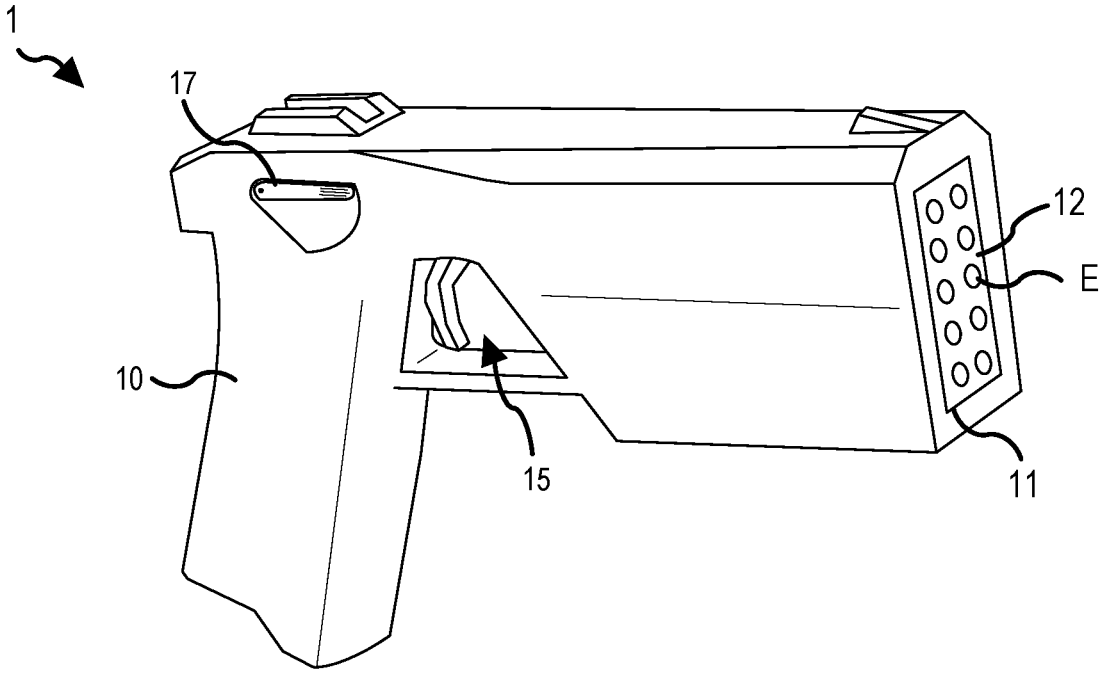
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes). Moreover, principles of the present disclosure may be applied to other less-lethal and non-lethal weapons and devices, including, for example, electronic devices configured to deploy projectiles towards a target, electronic devices configured for training purposes (e.g., to imitate less-lethal and/or non-lethal weapons), electronic devices configured for virtual reality (e.g., to imitate real-world use of less-lethal and/or non-lethal weapons), and/or the like.

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

In various embodiments, a CEW may include at least two terminals at the face of the CEW. A CEW may include two terminals for each bay that accepts a magazine. The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines. The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. In some embodiments, after use (e.g., activation, firing), a magazine may be removed from the bay and the used electrodes may be removed from the magazine and replaced with unused (e.g., not fired, not activated) electrodes. The magazine may be inserted into the bay again to permit launch of additional electrodes. In some embodiments, after use (e.g., activation, firing), a magazine may be removed from the bay and replaced with an unused (e.g., not fired, not activated) magazine to permit launch of additional electrodes.

Figure 2:
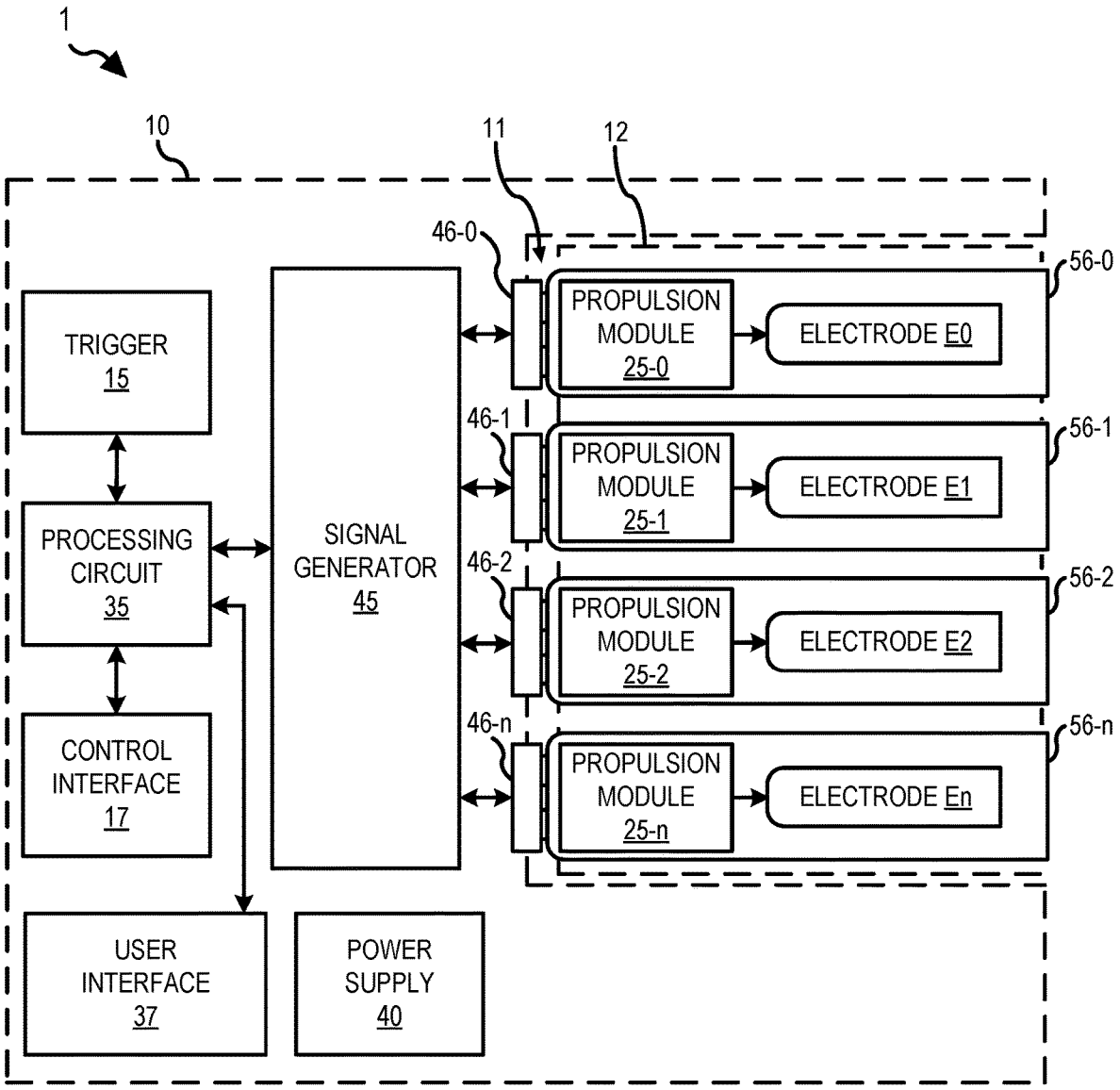
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 (e.g., a handle, a CEW handle, etc.) and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuitry. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible, non-transitory computer-readable memory. Instructions stored on the tangible non-transitory memory may allow processing circuit 35 to perform various operations, functions, and/or steps, as described herein.

The term "non-transitory" is to be understood to remove only propagating transitory signals per se from the claim scope and does not relinquish rights to all standard computer-readable media that are not only propagating transitory signals per se. Stated another way, the meaning of the terms "non-transitory computer-readable memory" and "non-transitory computer-readable storage medium" should be construed to exclude only those types of transitory computer-readable media which were found in In re Nuijten to fall outside the scope of patentable subject matter under 35 U.S.C. § 101.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, processing circuit 35 may comprise or be in electronic communication with a communications unit. The communications unit may be similar to, or comprise similar components with, any other communications unit, short-range communications unit, long-range communications unit, or the like disclosed here. The communications unit may enable electronic communications between devices and systems. The communications unit may enable communications over a network (e.g., network 402, with brief reference to FIG. 4). For example, the communications unit may include a modem, a network interface (such as an Ethernet card), a communications port, or the like. Data may be transferred via the communications unit in the form of signals which may be electronic, electromagnetic, optical, or other signals capable of being transmitted or received by a communications unit. The communications unit may be configured to communicate via any wired protocol, wireless protocol, or other protocol capable of transmitting information via a wired or wireless connection. In various embodiments, the communications unit may be configured to enable short-range communications between devices. In various embodiments, the communications unit may be configured to enable long-range communications between devices or systems. In various embodiments, the communications unit may be configured to enable both short-range communications and long-range communications.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode or cartridge in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

In various embodiments, magazine 12 may comprise a housing sized and shaped to be inserted into bay 11. The housing may define one or more bores. Each bore may define an opening through the housing (e.g., a chamber). Each bore may be configured to receive a projectile, a payload, or the like, such as a cartridge (e.g., cartridges 56). Each bore may be sized and shaped accordingly to receive and house a projectile, a payload, or the like prior to and during deployment of the projectile, a payload, or the like from magazine 12. Each bore may comprise any suitable deployment angle. One or more bores may comprise similar deployment angles. One or more bores may comprise different deployment angles. The housing may comprise any suitable or desired number of bores, such as, for example, two bores, five bores, nine bores, ten bores (e.g., as depicted), and/or the like.

In various embodiments, magazine 12 may be configured to receive one or more cartridges 56, such as, for example, a first cartridge 56-0, a second cartridge 56-1, a third cartridge 56-2, an "Nth" cartridge **56-*n*, and/or the like. Magazine 12 may be configured to receive a number of cartridges 56 equal to a number of bores in magazine 12. Each cartridge 56 may comprise a body configured to house an electrode (or other projectile) and one or more components necessary to deploy the electrode from the body. The electrode may be similar to any other electrode, projectile, or the like disclosed herein. The propulsion module may be similar to any other propulsion module, primer, or the like disclosed herein. For example, first cartridge 56-0 may comprise a first electrode E0 and a first propulsion module 25-0, second cartridge 56-1 may comprise a second electrode E1 and a second propulsion module 25-1, third cartridge 56-2 may comprise a third electrode E2 and a third propulsion module 25-2, Nth cartridge 56-*n* may comprise an Nth electrode En and an Nth propulsion module 25-*n***, etc.

As referred to herein, cartridges 56-0, 56-1, 56-2, **56-*n* may be generally referred to individually as a "cartridge 56" or collectively as "cartridges 56." As referred to herein, electrodes E0, E1, E2, En may be generally referred to individually as an "electrode E" or collectively as "electrodes E." As referred to herein, propulsion modules 25-0, 25-1, 25-2, 25-*n* may be referred to individually as a "propulsion module 25" or collectively as "propulsion modules 25**."

In various embodiments, each propulsion module 25 may be coupled to, or in communication with a respective electrode in a cartridge 56. For example, first propulsion module may be in communication (e.g., electrical communication, fluid communication, etc.) with first electrode E0, second propulsion module 25-1 may be in communication (e.g., electrical communication, fluid communication, etc.) with second electrode E1, third propulsion module 25-2 may be in communication (e.g., electrical communication, fluid communication, etc.) with third electrode E2, Nth propulsion module **25-*n*** may be in communication (e.g., electrical communication, fluid communication, etc.) with Nth electrode En, etc.

A propulsion module 25 may comprise any device, propellant (e.g., air, gas, etc.), primer, or the like capable of providing a propulsion force. The propulsion force may include an increase in pressure caused by rapidly expanding gas within an area or chamber (e.g., an interior of a cartridge body). The propulsion force may be applied to one or more electrodes E to cause the deployment of the one or more electrodes E. A propulsion module 25 may provide the propulsion force in response to a respective cartridge receiving an ignition signal, as previously discussed.

In various embodiments, the propulsion force may be directly applied to one or more electrodes E. For example, a propulsion force from propulsion module 25-0 may be provided directly to first electrode E0, a propulsion force from propulsion module 25-1 may be provided directly to second electrode E1, a propulsion force from propulsion module 25-2 may be provided directly to third electrode E2, a propulsion force from propulsion module **25-*n* may be provided directly to Nth electrode En, etc. A propulsion module 25 may be in fluid communication with one or more electrodes E to provide the propulsion force. For example, a propulsion force from a propulsion module 25 may travel within a housing or channel of a respective cartridge 56 to an electrode E. The propulsion force may travel via a manifold in the respective cartridge 56**.

In various embodiments, the propulsion force may be provided indirectly to one or more electrodes E. For example, the propulsion force may be provided to a secondary source of propellant within the propulsion system 25. The propulsion force may launch the secondary source of propellant within the propulsion system 25, causing the secondary source of propellant to release propellant. A force associated with the released propellant may in turn provide a force to one or more electrodes E. A force generated by a secondary source of propellant may cause the one or more electrodes E to be deployed from the respective cartridge 56.

In various embodiments, each electrode E0, E1, E2, En may comprise any suitable type of projectile. For example, one or more electrodes E may be or include a projectile, an electrode (e.g., an electrode dart), an entangling projectile (e.g., a tether-based entangling projectile, a net, etc.), a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

In various embodiments, signal generator 45 may be in electrical series with one or more cartridges 56 received by magazine 12. For example, signal generator 45 may be in electrical series with one or more electrical contacts 46 (e.g., first electrical contact 46-0, second electrical contact 46-1, third electrical contact 46-2, "Nth" electrical contact **46-*n*, etc.) (e.g., a handle contact, a handle electrical contact, etc.). Electrical contacts 46 may be at least partially exposed within bay 11. In response to magazine 12 being inserted within bay 11, electrical contacts 46 may engage one or more cartridges 56 loaded within magazine 12 (e.g., as depicted in FIG. 2). Each electrical contact 46 may be configured to be in electrical series with one or more cartridges 56, including a same cartridges 56 or separate cartridges 56. For example, first electrical contact 46-0 may be in electrical series with signal generator 45 and first cartridge 56-0, second electrical contact 46-1 may be in electrical series with signal generator 45 and second cartridge 56-1, third electrical contact 46-2 may be in electrical series with signal generator 45 and third cartridge 56-2, Nth electrical contact 46-*n* may be in electrical series with signal generator 45 and Nth cartridge 56-*n***, etc.

Signal generator 45 may be configured to provide one or more electrical signals to one or more cartridges 56 via one or more electrical contacts 46. For example, signal generator 45 and/or processing circuit 35 may control provision of electrical signals to electrical contacts 46. Signal generator 45 and/or processing circuit 35 may control provision of electrical signals by enabling and/or disabling an electrical connection (e.g., a first electrical connection, a second electrical connection, a next electrical connection, etc.). The electrical connection may define the electrical coupling between signal generator 45 and one or more respective electrical contacts 46. Signal generator 45 and/or processing circuit 35 may enable and/or disable electrical connections using any suitable technique or process, such as, for example, by selectively providing electrical signals, opening and/or closing circuits or switches, and/or the like. In some embodiments, providing an electrical signal may include providing a low voltage detection signal, an ignition signal, a stimulus signal, and/or the like.

In various embodiments, a cartridge 56 may comprise an electrical contact (e.g., a cartridge contact, a cartridge electrical contact, etc.) on an end of its respective cartridge body. The electrical contact may be configured to allow the cartridge 56 to receive an electrical signal from signal generator 45, via a contact 46.

For example, the electrical contact may be configured to enable the completion of an electrical circuit between the cartridge 56 and signal generator 45. In that regard, the electrical contact may be configured to transmit (or provide) a stimulus signal from signal generator 45, via an electrical contact 46, to a respective electrode E. As a further example, the electrical contact may be configured to transmit (or provide) an electrical signal (e.g., an ignition signal) from signal generator 45, via an electrical contact 46, to a respective propulsion module 25. For example, the electrical contact may be configured to transmit (or provide) the electrical signal to a conductor of the propulsion module 25, thereby causing the conductor to heat up and ignite a pyrotechnic material inside the propulsion module. Ignition of the pyrotechnic material may cause the propulsion module to deploy (e.g., directly or indirectly) the respective electrode E from the cartridge 56.

In various embodiment, the electrical contact for a cartridge 56 may comprise one or more electrical components configured to electrically couple to a respective handle electrical contact 46 in response to magazine 12 being inserted into bay 11. The electrical contact for a cartridge 56 may be configured to provide electrical signals to a respective cartridge 56, as previously discussed. Each electrical contact 46 may comprise one or more electrical connectors such as a pogo pin, a spring-loaded pin, an electrical contact, an electrical probe, and/or the like. For example, one or more electrical contacts 46 may comprise a signal pin. The signal pin may be positioned and configured to provide an electrical signal to a cartridge electrical contact of a cartridge electrically coupled to the handle contact 46. The signal pin may be configured to electrically couple to the cartridge electrical contact on a center point of an end of a cartridge.

As a further example, one or more electrical contacts 46 may comprise a ground pin. In some embodiments, the ground pin may be positioned and configured to provide an electrical signal to a cartridge electrical contact of a cartridge electrically coupled to the handle contact 46. In some embodiments, the ground pin may be positioned and configured to provide electrical grounding. The ground pin may be located radially outward from the signal pin and may be configured to contact the cartridge electrical contact at a location different from the signal pin on the end of the cartridge.

In various embodiments, the signal pin may be configured to contact a cartridge at a first location on the cartridge and the ground pin may be configured to contact the cartridge at a second location on the cartridge. The first location may be radially inward from the second location. The first location may comprise a substantially center location on an end of the cartridge. The second location may comprise an outer edge of an end of the cartridge. In various embodiments, the signal pin and/or the ground pin may be electrically coupled to (directly or in series) to one or more components of handle 10, such as, for example processing circuit 35, signal generator 45, and/or power supply 40.

In various embodiments, control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may comprise other modes operable into by control interface 17. For example, CEW 1 may comprise modes including a training mode, a manufacturing mode, a functional test mode, a stealth mode, a virtual reality mode, and/or the like. In these modes, one or more features or components of CEW 1 may be enabled or disabled compared to the standard firing mode and/or safety mode. For example, in the training mode a provision of a stimulus signal may be disabled. As a further example, in the stealth mode audio and/or light components may be disabled. As a further example, in the virtual reality mode, signals for deploying cartridges and/or provisional of a stimulus signal may be disabled.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
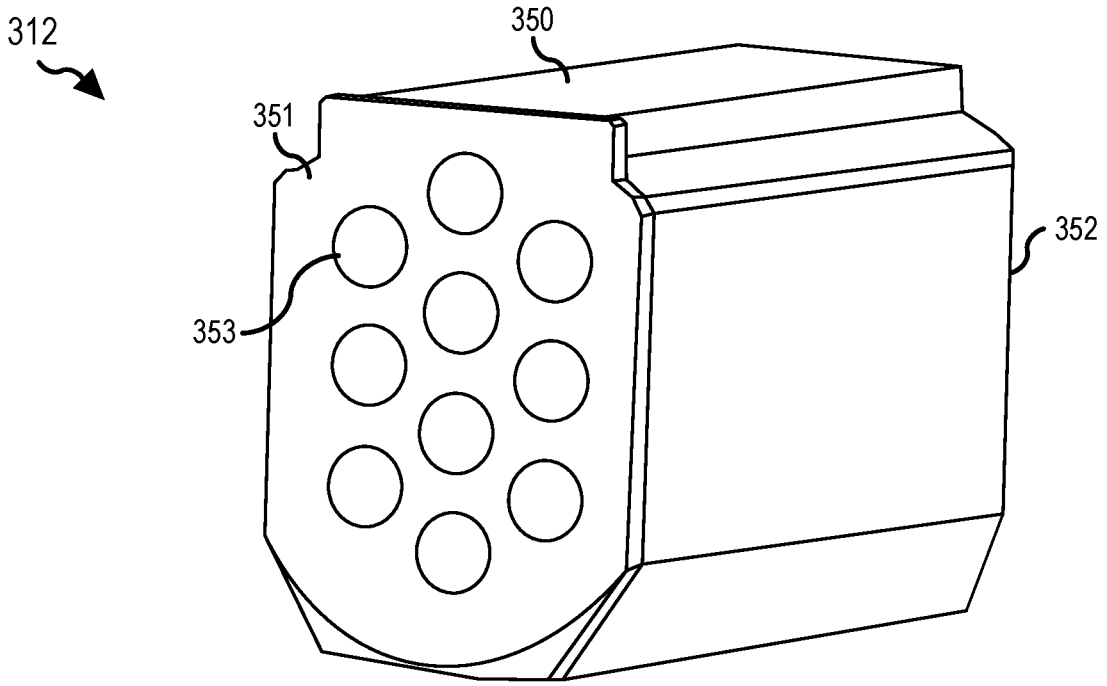
FIG. 3A is a front perspective view of a magazine for a CEW, in accordance with various embodiments.
Figure 3B:
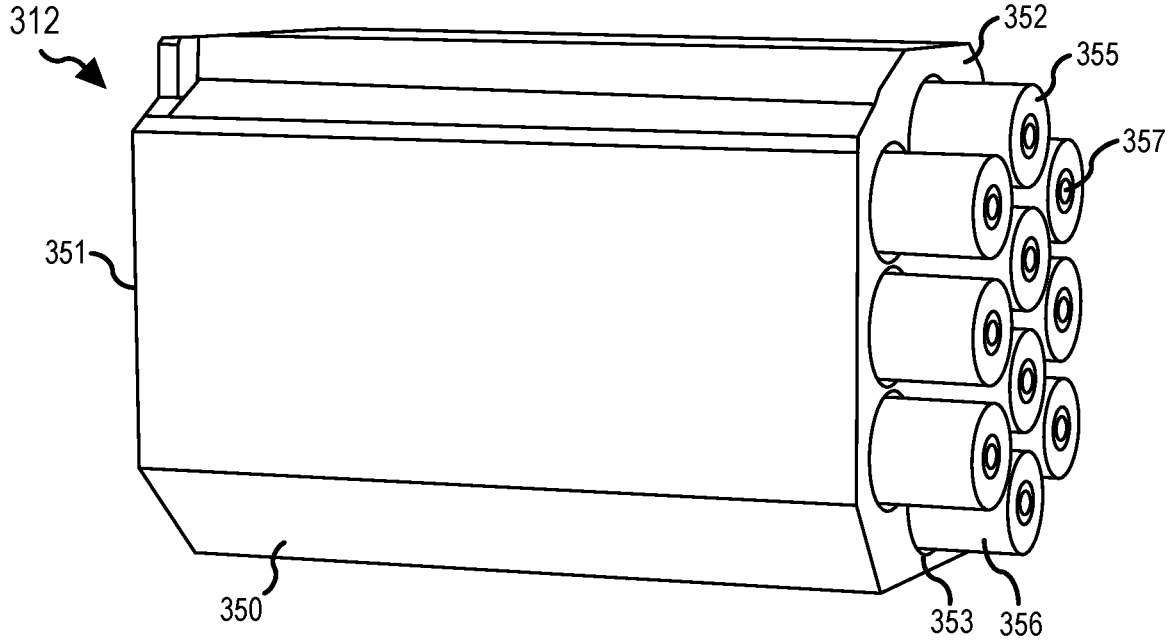
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes or cartridges from second end 352. Second end 352 may also be configured to permit provision of stimulus signals from the CEW to the one or more electrodes or cartridges. In some embodiments, magazine 312 may also be configured to permit loading of one or more electrodes or cartridges from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, five bores, nine bores, ten bores (e.g., as depicted), and/or the like.

In various embodiments, magazine 312 may be associated with a magazine identifier. The magazine identifier may define, or may be associated with, one or more magazine properties (e.g., characteristics, properties, capabilities, etc.). The magazine identifier may be detectable by a handle of a CEW. For example, a handle may comprise a detector configured to detect the magazine identifier. The detector may be in electronic communication with a processing circuit of the handle. The detector may be part of (e.g., a component of, integrated into, etc.) a processing circuit of the handle. The detector may comprise a sensor configured to detect the magazine identifier.

For example, in some embodiments, a magazine identifier for magazine 312 may comprise one or more indicium disposed in or on magazine 312. The indicium may comprise passive indicia, active indicia, and/or the like. For example, passive indicia may include magnetic materials (e.g., magnets), ferrous materials, ferrimagnetic materials, ferromagnetic materials, or combinations thereof. Passive indicia may comprise tags storing thereon unique identifiers, such as optical tags, barcodes, quick response (QR) codes, magnetic stripes, radio frequency identification (RFID) tags, near-field communication (NFC) tags, mechanical tags, electronic tags, physical indentation, extrusions, markings, tags, or combinations thereof. Active indicia may include radiofrequency transmitters, such as BLUETOOTH® transmitters. Active indicia may also comprise a processing circuit (e.g., a magazine processing circuit) and/or the like configured to communicate with a detector of a handle. In that respect, a detector for a handle may be configured to detect the passive indicia and/or the active indicia of the magazine identifier (e.g., in response to the handle receiving the magazine, in response to the handle receiving power, etc.). The passive indicia and/or the active indicia may define, or may be associated with, the one or more magazine properties.

In various embodiments, a detector may communicate with one or more magazine identifiers, as discussed above. For example, a detector may include an independent sensor for detecting each magazine identifier of a magazine. In one implementation, a detector includes a circuit having a reed relay to sense the existence of a magnet or flux circuit of suitable polarity, permittivity, and/or strength at one or more positions proximate to magazine 312. The positions may define a code that is detected by the detector and read by a processing circuit for governing operation of the CEW. Magazine 312 may have multiple magazine identifiers. A detector may have a corresponding plurality of sensors (e.g., reed relays).

In various embodiments, a magazine property may refer to capabilities, materials, features, payloads, and/or the like of a magazine. For example, a magazine property may define a number of bores in the magazine. For example, a magazine property may refer to a magazine type. A magazine type may indicate the types of payloads a magazine is capable of receiving. A magazine type may also indicate which bores in the magazine are capable of receiving particular types of payloads. A payload type may refer to a lethal payload, a less-lethal payload, and/or the like. For example, a payload type may comprise a rubber bullet type, a standard electrode type, an article penetrating electrode type, a training projectile type, an entangling projectile type (e.g., a tether-based entangling projectile, a net, etc.), a scent-based projectile type, a pepper spray projectile type (e.g., oleoresin capsicum, OC spray), a tear gas projectile type (e.g., 2-chlorobenzalmalononitrile, CS spray), and/or the like.

In some embodiments, a magazine type may also not comprise a payload (e.g., a non-payload type). For example, in some embodiments, a training magazine, a virtual reality magazine, and/or the like may comprise components that do not include a deployable payload.

As a further example, a magazine property may refer to propulsion capabilities of cartridges configured to be received by the magazine. For example, propulsion capabilities may include an effective deployable distance, a propulsion method, a propulsion speed, a propulsion type, and/or the like.

In various embodiments, magazine 312 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, filament wire, etc.), or any other projectile disclosed herein. The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In various embodiments, a cartridge 355 may be associated with a cartridge identifier. The cartridge identifier may define, or may be associated with, one or more cartridge properties (e.g., characteristics, properties, capabilities, etc.). The cartridge identifier may be detectable by a handle of a CEW. For example, a handle may comprise a detector configured to detect the cartridge identifier, as previously discussed.

For example, in some embodiments, a cartridge identifier for cartridge 355 may comprise one or more indicium disposed in or on cartridge 355. The indicium may comprise passive indicia, active indicia, and/or the like. For example, passive indicia may include magnetic materials (e.g., magnets), ferrous materials, ferrimagnetic materials, ferromagnetic materials, or combinations thereof. Passive indicia may comprise tags storing thereon unique identifiers, such as optical tags, barcodes, quick response (QR) codes, magnetic stripes, radio frequency identification (RFID) tags, near-field communication (NFC) tags, mechanical tags, electronic tags, physical indentation, extrusions, markings, tags, or combinations thereof. Active indicia may include radiofrequency transmitters, such as BLUETOOTH® transmitters. Active indicia may also comprise a processing circuit and/or the like configured to communicate with a detector of a handle. In that respect, a detector for a handle may be configured to detect the passive indicia and/or the active indicia of the cartridge identifier (e.g., in response to the handle receiving the magazine and interfacing with the cartridges, in response to the handle receiving power, etc.). The passive indicia and/or the active indicia may define, or may be associated with, the one or more cartridge properties.

In various embodiments, a cartridge property may define, or be associated with, a cartridge type. A cartridge type may refer to capabilities, materials, features, payloads, and/or the like of a cartridge. In some embodiments a cartridge type may comprise a lethal payload. In other embodiments, a cartridge type may comprise a less-lethal or non-lethal payload. For example, a cartridge type may comprise a rubber bullet type, a standard electrode type, an article penetrating electrode type, a training projectile type, an entangling projectile type (e.g., a tether-based entangling projectile, a net, etc.), a scent-based projectile type, a pepper spray projectile type (e.g., oleoresin capsicum, OC spray), a tear gas projectile type (e.g., 2-chlorobenzalmalononitrile, CS spray), and/or the like.

In various embodiments, a cartridge type may also not comprise a payload (e.g., a non-payload type). For example, in some embodiments, a training cartridge, a virtual reality cartridge, and/or the like may comprise components that do not include a payload.

In various embodiments, a cartridge type may refer to propulsion capabilities of a cartridge such as, for example, an effective deployable distance, a propulsion method, a propulsion speed, a propulsion type, and/or the like. In various embodiments, a cartridge type may refer to materials of a cartridge such as, for example, a non-metal cartridge body, a metal cartridge body, and/or the like.

In operation, a cartridge 355 may be inserted into a bore 353 of a magazine 312. The magazine 312 may be inserted into the bay of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 312 is capable of receiving may be dependent on a number of bores 353 in housing 350. For example, in response to housing 350 comprising ten bores 353, magazine 312 may be configured to receive at most ten cartridges 355 at the same time. As a further example, in response to housing 350 comprising two bores 353, magazine 312 may be configured to receive at most two cartridges 355 at the same time.

In various embodiments, activation of a CEW may cause deployment of one or more cartridges of a magazine (e.g., deployment of a projectile from the cartridge). For example, activation of a CEW may cause deployment of a single cartridge, two cartridges, three cartridges, etc. The cartridges may be deployed from a same magazine. The cartridges may be deployed from different magazines. Subsequent activations may cause deployment of additional one or more cartridges. For example, a first activation may cause deployment of a first set of one or more cartridges, a second activation may cause deployment of a second set of one or more cartridges, and the like. The number of activations may be limited in a single instance to a number of deployed cartridges equal to or less than the cartridges loaded into the magazine without reloading (or plurality of magazines received by a CEW handle).

Subsequent activations may occur during different periods of time. For example, a first activation may occur during a first period of time (or a first event) and a second activation may occur during a second period of time (or a second event), a first activation and a second activation may occur during a first period of time (or a first event) and a third activation may occur during a second period of time (or a second event), and/or the like. Between the first period of time and the second period of time, spent cartridges may be removed from the magazine and new or different cartridges may be inserted into the magazine.

Repeated deployments of cartridges from a magazine may degrade and/or wear components over time. Degradation and/or wear caused by repeated deployments may occur within the magazine and/or the handle of the CEW. Degradation and/or wear of components may lead to component failure, a shortened component lifespan, and/or the like.

In some embodiments, repeated deployments of cartridges from a magazine may also cause degradation and/or wear on or within the cartridge. For example, a cartridge body may degrade and/or wear over time. Degradation and/or wear of cartridge components may lead to a cartridge failing to properly deploy a projectile, component failure, a shortened component lifespan, and/or the like.

For example, deployment of a cartridge may cause movement of the cartridge within a bore of a magazine. Movement of the cartridge may cause friction within the bore of the magazine the cartridge is loaded into (e.g., friction between a surface of the bore and a surface of the cartridge body). Movement of the cartridge may cause impact of the cartridge body against one or more surfaces within the bore of the magazine the cartridge is loaded into. Repeated friction and/or impact may cause degradation and/or wear within the respective bore of the magazine. Repeated friction and/or impact may also cause degradation and/or wear to the cartridge body and/or other components of the cartridge.

As a further example, deployment of a cartridge may cause movement of the cartridge against one or more components of the handle. Movement of the cartridge may include an axial impact of the cartridge against the bay of the handle (e.g., recoil). As previously discussed, a cartridge may be electrically coupled to one or more components of a handle via a handle electrical contact. The handle electrical contact may be in physical contact with the cartridge during deployment of the cartridge. Movement of the cartridge during deployment may cause the cartridge to impact or otherwise provide a force against the respective handle electrical contact. Repeated impact and/or provided force of cartridges against a handle contact may cause degradation and/or wear to the handle contact.

In various embodiments, a CEW may distribute deployments of cartridges. The CEW may distribute deployments of cartridges amongst different handle electrical contacts, magazine bores, cartridges, and/or the like. The CEW may distribute deployments during a deployment event (e.g., a period of time). The CEW may distribute deployments across different deployment events, such as, for example, a first deployment event separated by a period of time from a second deployment event.

Distributing deployments of cartridges may ensure that degradation and/or wear of components is effectively and/or evenly distributed amongst the respective components of electrical connections used for deployment. For example, a CEW that does not distribute deployments may select a first electrical connection (e.g., a first handle electrical contact corresponding with a first magazine bore) for deployment at the beginning of each deployment event. Over time, the first electrical connection may be used more frequently than the other electrical connections. Accordingly, the components corresponding to the first electrical connection may degrade and/or wear at a rate faster than the respective components of other electrical connections. In some embodiments, distributing deployments may therefore at least partially ensure that respective components of each electrical connection degrade and/or wear at similar, or at least partially similar, rates.

In various embodiments, distributing deployments of cartridges may comprise maintaining a sequence of deployment between deployment events, reloading of cartridges, and the like.

In various embodiments, distributing deployments of cartridges may comprise selectively enabling electrical connections between a handle and a cartridge in a magazine. Enabling the electrical connection may allow the handle to transmit signals to the cartridge, such as an ignition signal and/or a stimulus signal. Enabling an electrical connection may refer to enabling one or more electrical connections. Electrical connections may be enabled in an order to distribute deployments of cartridges.

In various embodiments, distributing deployments of cartridges may comprise selectively deploying cartridges from a same magazine (e.g., all of the cartridges are loaded and deployed from a single magazine). In various embodiments, distributing deployments of cartridges may comprise selectively deploying cartridges from a plurality of magazines.

In various embodiments, a CEW may distribute deployments using any suitable process and/or technique. The CEW may distribute deployments based on data, commands, lists, or the like. The CEW may retrieve the data, commands, lists, or the like from an internal memory of the CEW. The CEW may receive the data, commands, lists, or the like from an external source, such as from a user input, an electronic device in communication with the CEW, a network resource, a server, a record management system, and/or the like. The CEW may retrieve the data, commands, lists, or the like based on a type of magazine received by a handle (e.g., based on a magazine property), one or more types of cartridges loaded into the magazine (e.g., based on a cartridge property), and/or the like.

For example, a CEW may distribute deployments based on a deployment list. The deployment list may comprise an ordered list of electrical connections (or data representing an ordered list of electrical connections), cartridges, and/or the like. The deployment list may be structured as a list, a table, and/or in any other suitable format or data structure. The deployment list may comprise a marker (e.g., a note, metadata, etc.) indicating a last enabled electrical connection (e.g., the electrical connection last enabled for deployment) or a next electrical connection (e.g., the electrical connection to be enabled next for deployment), a last deployed cartridge or a next cartridge for deployment, and/or the like. The deployment list may also be dynamically reordered during (or after) deployments such that the first electrical connection, the first cartridge, and/or the like in the deployment list is the next electrical connection, the next cartridge, and/or the like to be enabled for deployment.

In other embodiments, the deployment list may comprise data indicating a last enabled electrical connection or a next electrical connection, a last deployed cartridge or a next cartridge for deployment, and/or the like. In that regard, a processing circuit may select and/or determine an order for distributing deployments based on the last enabled electrical connection or the next electrical connection, the last deployed cartridge or the next cartridge for deployment, and/or the like. For example, a deployment order may be sequential, and the processing circuit may determine an electrical connection to enable based on the last enabled electrical connection or the next electrical connection, the last deployed cartridge or the next cartridge for deployment, and/or the like.

In some embodiments, a deployment list may be randomly generated. The deployment list may be randomly generated before or with an activation event, and/or at any other suitable interval. Randomly generating a deployment list may include determining a deployment order of each electrical connection, cartridge, or the like. A deployment list may be randomly generated using any suitable process or technique, including random number generators known in the art.

In some embodiments, a deployment list may be dynamically generated. The deployment list may be dynamically generated before or with an activation event, and/or at any other suitable interval. The deployment list may be dynamically generated based on data associated with the CEW handle, the magazine, and/or cartridges of the magazine, such as deployment data, an operating setting, a user input, an available connection, and/or the like. The deployment list may be dynamically generated using any suitable process or technique.

In some embodiments, the deployment list may be stored on the handle of the CEW (e.g., in memory). In some embodiments, the deployment list may be stored on an electronic device. In some embodiments, the deployment list may be stored in a network server or device, such as a server, record management system, or the like.

As an example, in various embodiments, a magazine may comprise six bores including a first bore, a second bore, a third bore, a fourth bore, a fifth bore, and a sixth bore. Each bore may contain a cartridge capable of deploying a projectile. Each bore and respective cartridge may be aligned with an electrical connection of a CEW handle, in response to the magazine being coupled to the CEW handle. The electrical connection may comprise an electrical path between electrical components of the CEW handle and the electrical contacts configured to electrically couple a cartridge to the CEW handle. Distributing deployments may therefore include distributing deployments across bores, cartridges, and/or electrical connections. One or more bores, cartridges, and/or electrical connections may be collectively referred to in the following paragraphs as "deployment connections." For example, a first deployment connection may comprise one or more of a first bore, a first cartridge in the first bore, and/or a first electrical connection; a second deployment connection may comprise one or more of a second bore, a second cartridge in the second bore, and/or a second electrical connection; a third deployment connection may comprise one or more of a third bore, a third cartridge in the third bore, and/or a third electrical connection; a fourth deployment connection may comprise one or more of a fourth bore, a fourth cartridge in the fourth bore, and/or a fourth electrical connection; a fifth deployment connection may comprise one or more of a fifth bore, a fifth cartridge in the fifth bore, and/or a fifth electrical connection; a sixth deployment connection may comprise one or more of a sixth bore, a sixth cartridge in the sixth bore, and/or a sixth electrical connection; and/or the like. Although referred collectively as a deployment connection, the following discussion can be applied to the collective components and/or to each individual component of a deployment connection, such as for distributing deployments across different bores, distributing deployments across different cartridges, and/or distributing deployments across different electrical connections.

In a CEW configured to randomly distribute deployments, in accordance with various embodiments, the CEW handle (e.g., a processing circuit of the CEW handle) may randomly generate a deployment order prior to an activation event. For example, before a first activation event, the CEW handle may randomly generate a deployment order (e.g., a first random deployment order) of the second deployment connection, the fifth deployment connection, the third deployment connection, the sixth deployment connection, the first deployment connection, and the fourth deployment connection. During the first activation event, a first deployment causes a cartridge deployment from the second deployment connection, a second deployment causes a cartridge deployment from the fifth deployment connection, and a third deployment causes a cartridge deployment from the third deployment connection, each in accordance with the first random deployment order. After the first activation event, the three spent cartridges may be replaced with new cartridges such that each deployment connection again contains a cartridge capable of deploying a projectile. Before a second activation event, the CEW handle may again randomly generate a deployment order (e.g., a second random deployment order) of the sixth deployment connection, the second deployment connection, the fourth deployment connection, the third deployment connection, the fifth deployment connection, and the first deployment connection. During the second activation event, a first deployment causes a cartridge deployment from the sixth deployment connection, a second deployment causes a cartridge deployment from the second deployment connection, a third deployment causes a cartridge deployment from the fourth deployment connection, and a fourth deployment causes a cartridge deployment from the third deployment connection, each in accordance with the second random deployment order. In that regard, the CEW handle may randomly generate a new deployment order before each new activation event.

A magazine may comprise one or more deployment connections without an available cartridge for deployment. In that regard, and in accordance with various embodiments, during a random distribution of deployments the CEW handle may detect whether a next deployment connection has an available cartridge. In response to the next deployment connection having an available cartridge, the CEW handle may proceed with causing a cartridge deployment from that deployment connection. In response to the next deployment connection not having an available cartridge, the CEW handle may skip the deployment connection and detect whether the next deployment connection in the deployment order has an available cartridge. In other embodiments, the CEW handle may detect whether each deployment connection has an available cartridge prior to generating the deployment order. In that respect, the generated random deployment order may comprise only deployment connections available for a deployment.

In a CEW configured to distribute deployments based on a deployment list, in accordance with various embodiments, the CEW handle may retrieve the deployment list prior to an activation event. The deployment list may define a deployment order, such as the first deployment connection, the second deployment connection, the third deployment connection, the fourth deployment connection, the fifth deployment connection, and the sixth deployment connection, and/or any other desired ordering of the deployment connections. The deployment list may comprise a deployment marker indicating a next deployment connection for a deployment (or the deployment connection last deployed, etc.). For example, before a first activation event the CEW handle may retrieve the deployment list. During the first activation event, and in response to the deployment marker in the deployment list indicating that the fourth deployment connection is the next deployment connection for a deployment, a first deployment causes a cartridge deployment from the fourth deployment connection, a second deployment causes a cartridge deployment from the fifth deployment connection, a third deployment causes a cartridge deployment from the sixth deployment connection, and a fourth deployment causes a cartridge deployment from the first deployment connection, each in accordance with the deployment list. After each deployment, or after the first activation event, the CEW handle may move the marker according to the number of deployments. In the above example, the deployment marker could be moved to the first deployment connection to indicate the deployment connection last deployed or to the second deployment connection to indicate the next deployment connection for deployment. After the first activation event, the four spent cartridges may be replaced with new cartridges such that each deployment connection again contains a cartridge capable of deploying a projectile. Before a second activation event, the CEW handle may again retrieve the deployment list. During the second activation event, a first deployment causes a cartridge deployment from the second deployment connection, a second deployment causes a cartridge deployment from the third deployment connection, and so forth. After each deployment, or after the second activation event, the CEW handle may move the marker according to the number of deployments. For example, in response to two deployments during the second activation event as described above, the deployment marker could be moved to the third deployment connection to indicate the deployment connection last deployed or to the fourth deployment connection to indicate the next deployment connection for deployment. In that regard, the deployment order may proceed sequentially during separate activation events.

In various embodiments, a magazine may comprise one or more deployment connections without an available cartridge for deployment (e.g., a bore without a loaded cartridge, a bore with a spent cartridge, a bore with an improper or defective cartridge, a bad electrical connection, etc.). In that regard, during a distribution of deployments based on a deployment list the CEW handle may detect whether a next deployment connection has an available cartridge. In response to the next deployment connection having an available cartridge, the CEW handle may proceed with causing a cartridge deployment from that deployment connection. In response to the next deployment connection not having an available cartridge, the CEW handle may skip the deployment connection and detect whether the next deployment connection in the deployment order has an available cartridge.

In some embodiments, a deployment list may be stored locally in memory (e.g., CEW handle memory) of a CEW handle. The CEW handle (e.g., a processing circuit of the CEW handle) may retrieve the deployment list from memory prior to or with an activation event. For example, the CEW handle may retrieve the deployment list in response to a control interface of the CEW handle enabling deployments from the CEW handle, in response to one or more components of the CEW handle receiving power, and/or responsive to any other event prior to or with an activation event. Responsive to deployments during the activation event, the CEW handle may update and store the deployment list in memory. The CEW handle may update and store during the activation event, after the activation event, in response to the control interface of the CEW handle disabling deployments from the CEW handle, in response to one or more components of the CEW handle no longer receiving power, and/or the like.

In some embodiments, a deployment list may be stored remotely in memory (e.g., electronic device memory) of an electronic device. The CEW handle (e.g., a processing circuit of the CEW handle) may retrieve the deployment list from the electronic device prior to or with an activation event. For example, the CEW handle may establish a connection (e.g., short-range wireless connection, long-range wireless connection, network connection, wired connection, etc.) with the electronic device. The CEW handle may establish the connection in response to a control interface of the CEW handle enabling deployments from the CEW handle, in response to one or more components of the CEW handle receiving power, and/or responsive to any other event prior to or with an activation event. The CEW handle may retrieve the deployment list from the electronic device. The CEW handle may retrieve the deployment list in response to establishing the connection with the electronic device, in response to the control interface of the CEW handle enabling deployments from the CEW handle, in response to one or more components of the CEW handle receiving power, and/or responsive to any other event prior to or with an activation event. Responsive to deployments during the activation event, the CEW handle may update and store the deployment list in local memory. The CEW handle may update and store during the activation event, after the activation event, in response to the control interface of the CEW handle disabling deployments from the CEW handle, in response to one or more components of the CEW handle no longer receiving power, and/or the like. The CEW handle may transmit the updated deployment list to the electronic device. For example, the CEW handle may transmit the updated deployment list during the activation event, after the activation event, in response to the control interface of the CEW handle disabling deployments from the CEW handle, in response to one or more components of the CEW handle no longer receiving power, and/or the like.

In some embodiments, a deployment list may be stored remotely in memory (e.g., magazine memory) of a magazine. The CEW handle (e.g., a processing circuit of the CEW handle) may retrieve the deployment list from the magazine prior to or with an activation event. For example, the CEW handle may mechanically and electronically couple to the magazine. The CEW handle may retrieve the deployment list from the magazine. The CEW handle may retrieve the deployment list in response to mechanically and electronically coupling to the magazine, in response to a control interface of the CEW handle enabling deployments from the CEW handle, in response to one or more components of the CEW handle receiving power, and/or responsive to any other event prior to or with an activation event. Responsive to deployments during the activation event, the CEW handle may update and store the deployment list in local memory. Responsive to deployments during the activation event, the CEW handle may update, store, and transmit the deployment list in the memory of the magazine. The CEW handle may update and store during the activation event, after the activation event, in response to the control interface of the CEW handle disabling deployments from the CEW handle, in response to one or more components of the CEW handle no longer receiving power, and/or the like. The CEW handle may transmit the updated deployment list to the magazine. For example, the CEW handle may transmit the updated deployment list during the activation event, after the activation event, in response to the control interface of the CEW handle disabling deployments from the CEW handle, in response to one or more components of the CEW handle no longer receiving power, and/or the like.

In some embodiments, a deployment list may be stored remotely in memory (e.g., record database) of a record management system. The CEW handle (e.g., a processing circuit of the CEW handle) may retrieve the deployment list from the record management system prior to or with an activation event. For example, the CEW handle may establish a connection (e.g., short-range wireless connection, long-range wireless connection, network connection, wired connection, etc.) with the record management system. The CEW handle may establish the connection in response to a control interface of the CEW handle enabling deployments from the CEW handle, in response to one or more components of the CEW handle receiving power, and/or responsive to any other event prior to or with an activation event. The CEW handle may retrieve the deployment list from the record management system. The CEW handle may retrieve the deployment list in response to establishing the connection with the record management system, in response to the control interface of the CEW handle enabling deployments from the CEW handle, in response to one or more components of the CEW handle receiving power, and/or responsive to any other event prior to or with an activation event. In some embodiments, the CEW handle may be docked at a law enforcement agency between active shifts. While docked, the CEW handle may transmit and receive data from the record management system. In that respect, the CEW handle may retrieve the deployment list while docked. The CEW handle may store the deployment list in local memory until the CEW handle is docked again. Responsive to deployments during the activation event, the CEW handle may update and store the deployment list in local memory. The CEW handle may update and store during the activation event, after the activation event, in response to the control interface of the CEW handle disabling deployments from the CEW handle, in response to one or more components of the CEW handle no longer receiving power, and/or the like. The CEW handle may transmit the updated deployment list to the record management system. For example, the CEW handle may transmit the updated deployment list during the activation event, after the activation event, in response to the control interface of the CEW handle disabling deployments from the CEW handle, in response to one or more components of the CEW handle no longer receiving power, and/or the like. In some embodiments, the CEW handle may transmit the updated deployment list in response to being docked again, such as, for example, at the end of a shift.

In a CEW configured to distribute deployments based on a dynamic deployment list, in accordance with various embodiments, the CEW handle may generate the dynamic deployment list prior to or with an activation event. The CEW handle may generate the dynamic deployment list based on one or more of a deployment list (as previously discussed), deployment data, an operating setting, a user input, an available connection, and/or the like.

Deployment data may include data regarding deployments of deployment connections of the handle. For example, deployment data may include data regarding deployments from electrical connections of the handle (e.g., handle deployment data), bores of the magazine (e.g., magazine deployment data), cartridges loaded in the bores of the magazine (e.g., cartridge deployment data), and/or the like.

For example, the handle deployment data may include a deployment count (e.g., a handle deployment count) for each electrical connection of the handle (e.g., a first electrical connection, a second electrical connection, a third electrical connection, a fourth electrical connection, a fifth electrical connection, a sixth electrical connection, etc.). Each deployment count may include a number of deployments caused by each electrical connection (e.g., 24 deployments from the first electrical connection, 30 deployments from the second electrical connection, etc.). The handle deployment data may be stored in memory of the CEW handle, externally in an electronic device and/or record management system, and/or any other suitable location.

For example, the magazine deployment data may include a deployment count (e.g., a magazine deployment count) for each bore of the magazine (e.g., the first bore, the second bore, the third bore, the fourth bore, the fifth bore, the sixth bore, etc.). Each deployment count may include a number of deployments that occurred in each bore (e.g., 15 deployments from the first bore, 43 deployments from the second bore, etc.). In some embodiments, the magazine deployment data may be stored in memory of the CEW handle, memory of the magazine, memory of an electronic device, memory of a record management system, and/or the like. In some embodiments, the CEW handle may communicate with the magazine to determine a magazine identifier associated with the magazine. The magazine identifier may indicate and/or be associated with the magazine deployment data. For example, the CEW handle may query memory based on the magazine identifier to determine the magazine deployment data associated with the magazine identifier. The CEW handle may query memory of the CEW handle, memory of an electronic device, memory of a record management system, and/or the like to determine and retrieve the magazine deployment data.

For example, the cartridge deployment data may include a deployment count (e.g., a cartridge deployment count) for each cartridge loaded into bores of the magazine (e.g., a first cartridge in the first bore, a second cartridge in the second bore, etc.). Each deployment count may include a number of deployments from the associated cartridge (e.g., 46 deployments from the first cartridge, 51 deployments from the second cartridge, etc.). In some embodiments, the cartridge deployment data may be stored in memory of the CEW handle, memory of the cartridge, memory of an electronic device, memory of a record management system, and/or the like. In some embodiments, the CEW handle may communicate with the cartridge to determine a cartridge identifier associated with the cartridge. The cartridge identifier may indicate and/or be associated with the cartridge deployment data. For example, the CEW handle may query memory based on the cartridge identifier to determine the cartridge deployment data associated with the cartridge identifier. The CEW handle may query memory of the CEW handle, memory of an electronic device, memory of a record management system, and/or the like to determine and retrieve the cartridge deployment data.

In various embodiments, deployment data may be updated responsive to deployments and/or activation events. For example, responsive to a first deployment at a first electrical connection, the deployment count for the first electrical connection may be increased by one. As a further example, responsive to a second deployment of a fourth cartridge, the deployment count for the fourth cartridge may be increased by one. As a further example, responsive to a third deployment of a fifth bore, the deployment count for the fifth bore may be increased by one. As a further example, responsive to a fourth deployment at a second deployment connection, the deployment count for each of the associated second bore, second electrical connection, and/or second cartridge may be increased by one.

In various embodiments, deployment data may be variably updated responsive to deployments and/or activation events. For example, deployments of different cartridge types may exert more force, and more associated wear and degradation, on handle and magazine components. In that regard, a cartridge having a greater propulsion force may cause more wear and degradation on components compared to a cartridge having a lower propulsion force. Similarly, a cartridges that deploy different types of payloads, or no payload at all, may also produce variable wear and degradation on components. Accordingly, deployment data may include a variable deployment count wherein the variable deployment count is updated differently based on cartridge properties (e.g., as discussed below). For example, responsive to a first deployment at a first deployment connection having a first cartridge with a standard cartridge type, the deployment count for each of the associated first bore, first electrical connection, and/or first cartridge may be increased by one. Responsive to a second deployment at a second deployment connection having a second cartridge with a greater propulsion force, the deployment count for each of the associated second bore, second electrical connection, and/or second cartridge may be increased by two. In various embodiments, maintenance of CEW components may also decrease a variable deployment count. For example, in response to maintenance of a cartridge (e.g., replacing cartridge contacts, etc.) the variable deployment count may be decreased by one (e.g., manually decreased by input from a user recording the maintenance event).

An operating setting may include data regarding settings, characteristics, properties, capabilities, and/or the like of the CEW handle, the magazine, and/or the cartridge. An operating setting may include a handle operating setting, a magazine operating setting, and/or a cartridge operating setting.

For example, a handle operating setting may include data regarding settings, characteristics, properties, capabilities, and/or the like of the CEW handle. For example, a handle operating setting may define a number of electrical connections, deployment capabilities of the handle, available battery or power of the handle, agency requirements or restrictions, and/or the like. The handle operating setting may be stored in memory of the CEW handle, externally in an electronic device and/or record management system, and/or any other suitable location.

For example, a magazine operating setting may include data regarding settings, characteristics, properties, capabilities, and/or the like of the magazine. For example, a magazine operating setting may define a magazine property, a number of bores in the magazine, a magazine type, and/or the like. In some embodiments, the magazine operating setting may be stored in memory of the CEW handle, memory of the magazine, memory of an electronic device, memory of a record management system, and/or the like. In some embodiments, the CEW handle may communicate with the magazine to determine a magazine identifier associated with the magazine. The magazine identifier may indicate and/or be associated with the magazine operating setting. For example, the CEW handle may query memory based on the magazine identifier to determine the magazine operating setting associated with the magazine identifier. The CEW handle may query memory of the CEW handle, memory of an electronic device, memory of a record management system, and/or the like to determine and retrieve the magazine operating setting.

For example, a cartridge operating setting may include data regarding settings, characteristics, properties, capabilities, and/or the like of each cartridge. For example, a cartridge operating setting may define a cartridge property, a cartridge type, and/or the like. In some embodiments, the cartridge operating setting may be stored in memory of the CEW handle, memory of the cartridge, memory of an electronic device, memory of a record management system, and/or the like. In some embodiments, the CEW handle may communicate with the cartridge to determine a cartridge identifier associated with the cartridge. The cartridge identifier may indicate and/or be associated with the cartridge operating setting. For example, the CEW handle may query memory based on the cartridge identifier to determine the cartridge operating setting associated with the cartridge identifier. The CEW handle may query memory of the CEW handle, memory of an electronic device, memory of a record management system, and/or the like to determine and retrieve the cartridge operating setting.

A user input may include data regarding user preferences, inputs, requests, operations, and/or the like of the CEW handle. For example, a user may interact with the CEW handle (e.g., via the control interface, via a user interface, etc.) to input the user input. The user input may comprise a handle mode. For example, a CEW handle may be configured to operate between different modes, including a firing mode, a safety mode, a training mode, a manufacturing mode, a functional test mode, a stealth mode, a virtual reality mode, and/or the like. Responsive to the CEW handle being operated into different modes, different options and capabilities of the CEW handle may be enabled or disabled. The user input may comprise a cartridge selection. For example, as previously discussed a cartridge may comprise different cartridge properties and/or cartridge types. A cartridge selection may include the cartridge properties and/or cartridge types that the user desires for deployment from the CEW handle. The user input may comprise a deployment selection. For example, a deployment selection may specify a number of cartridges to deploy with each deployment, a desired location for a deployment, and/or the like. Data associated with the user input may be stored (e.g., temporarily, permanently, etc.) in memory of the CEW handle.

An available connection may include data indicating which electrical connections and/or cartridges are available for deployment. For example, the available connection may include data indicating the electrical connections and/or cartridge available for deployment (e.g., first connection, third connection, first cartridge, third cartridge, etc.) and the electrical connections and/or cartridge not available for deployment (e.g., first connection, third connection, first cartridge, third cartridge, etc.). In some embodiments, an electrical connection may not be available for deployment if no cartridge is loaded into the associated magazine bore, if the cartridge in the associated magazine bore is spent or defective, if the cartridge loaded into the associated magazine bore is incompatible, and/or the like. A CEW handle may detect available connections using any suitable process. For example, in some embodiments the CEW handle may transmit an electrical signal (e.g., a low voltage signal) through each electrical connection. The electrical signal may be configured to complete an electrical circuit without causing deployment of a cartridge. In response to the CEW handle detecting that the electrical circuit is complete, the associated electrical connection may be available. In response to the CEW handle detecting that the electrical circuit is not complete (e.g., an open circuit), the associated electrical connection may not be available. Data associated with the available connection may be stored (e.g., temporarily, permanently, etc.) in memory of the CEW handle.

The CEW handle may generate the dynamic deployment list using any suitable process or technique. The dynamic deployment list may define a deployment order, similar to the above-described deployment list (e.g., first electrical connection, fifth electrical connection, third electrical connection, etc.). In some embodiments, one or more of the deployment list, the deployment data, the operating setting, the user input, the available connection, and/or the like may be prioritized and/or weighted during the generating. For example, data regarding available connections may be prioritized over the deployment list, the deployment data, the operating setting, the user input, and/or the like. As a further example, one or more of the available connection, the operating setting, and the user input may be prioritized and/or weighted over the deployment data. In some embodiments, generating a dynamic deployment list may ensure that deployments are distributed evenly (or optimally distributed) based on available data for the CEW handle, the magazine, and/or the cartridge.

In various embodiments, a CEW may generate a dynamic deployment list before each activation event. In various embodiments, a CEW may generate a dynamic deployment list at intervals of activation events or time. For example, the CEW may generate a dynamic deployment list at time intervals, such as once a month, once a quarter, once a year, etc. The CEW may generate a dynamic deployment list at activation event intervals, such as before every fifth activation event, before every tenth activation event, etc. The CEW may generate a dynamic deployment list based on a user input (e.g., a user request to generate a dynamic deployment list). In such embodiments, a marker may be used by the CEW handle to update the dynamic deployment list between intervals (e.g., as described above with reference to the deployment list).

In various embodiments, activation events may be separated by a period of time. For example, a first activation event may comprise one or more deployments; after a period of time, a second activation event may comprise one or more separate deployments; etc. An activation event may be defined as a grouping of one or more associated deployments.

For example, in some embodiments, an activation event may begin in response to a control interface being operated into an active mode and may end in response to the control interface being operated into a safety mode. The activation event may include one or more deployments occurring between the control interface operations.

As a further example, an activation event may be defined independent of one or more of the operation of the control interface into the active mode and/or the operation of the control interface into the safety mode. The activation event may include deployments occurring between coupling of a magazine to the CEW handle and decoupling of the magazine from the CEW handle. The activation event may include one or more associated deployments occurring within a period of time (e.g., a deployment time period, a deployment time window, etc.). For example, all deployments occurring within a twenty second period of time may be grouped in an activation event (e.g., ten second period of time, thirty second period of time, one minute period of time, any other desired period of time). Deployments occurring outside the period of time may be grouped into a separate activation event. The activation event may include one or more associated deployments occurring within a period of time (e.g., a deployment proximity, a deployment time proximity, etc.) of each other. For example, each deployment occurring within ten seconds (e.g., five seconds, twenty seconds, any other desired period of time) of each other may be grouped as an activation event. In that regard, for a first deployment occurring at X time, a second deployment occurring at X+5 seconds time, a third deployment occurring at X+45 seconds time, and a fourth deployment occurring at X+51 seconds time, the first deployment and the second deployment may be grouped as a first activation event, and the third deployment and the fourth deployment may be grouped as a second activation event.

The period of time between activation events may include a reloading event. During a reloading event, a magazine may be decoupled from a CEW handle and cartridges may be removed from the magazine and/or new cartridges may be inserted (e.g., loaded) into the magazine. For example, spent cartridges may be removed from the magazine and replaced with new cartridges. As a further example, cartridges may be removed from the magazine at the end of a shift and new cartridges may be inserted into the magazine at the start of a new shift.

Figure 4:
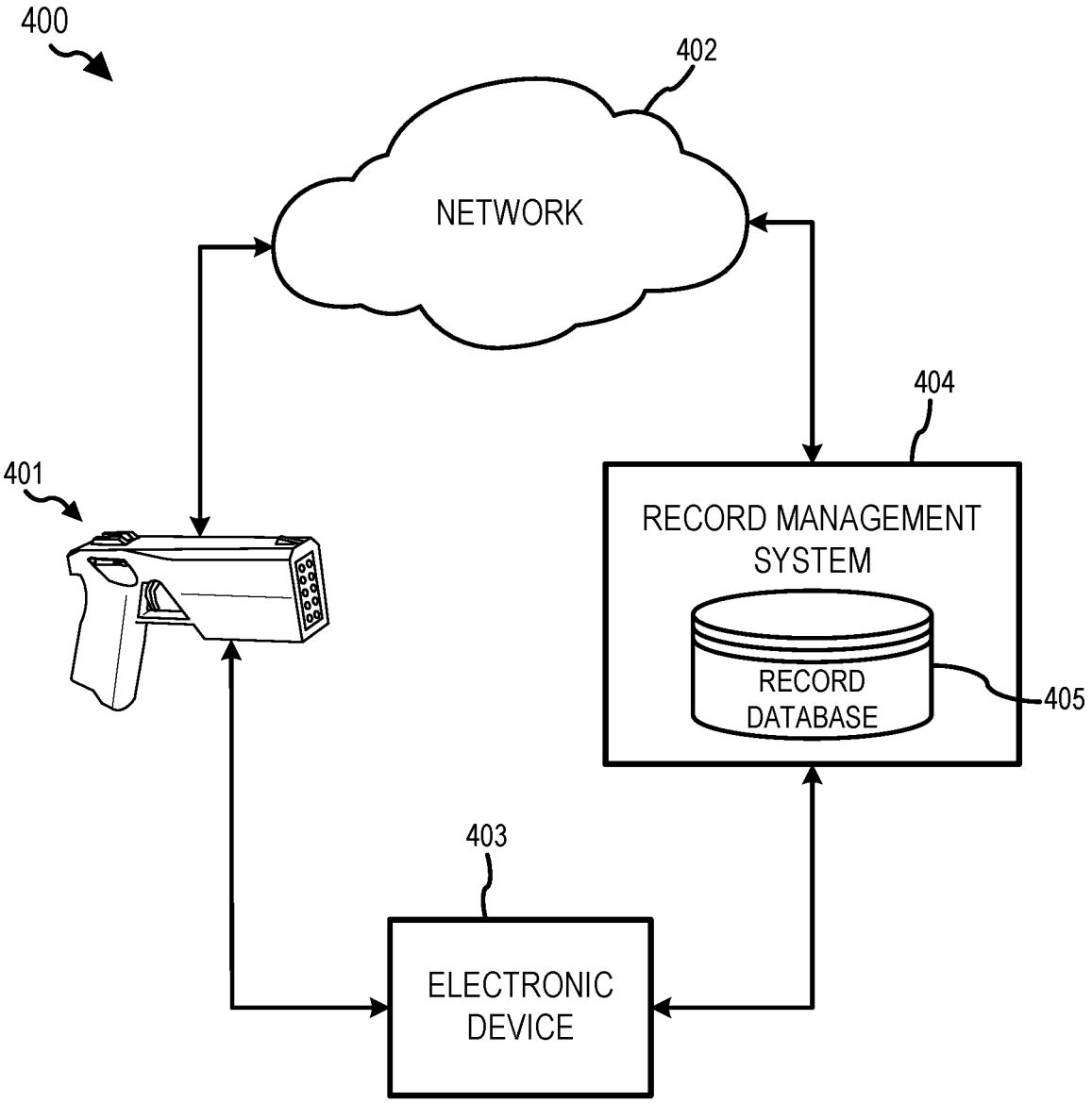
FIG. 4 is a block diagram for a CEW ecosystem, in accordance with various embodiments.

In various embodiments, and with reference to FIG. 4, a conducted electrical weapon (CEW) ecosystem 400 is disclosed. CEW ecosystem 400 may comprise one or more of a CEW 401, an electronic device 403, and/or a record management system 404. In some embodiments, one or more of CEW 401, electronic device 403, and/or record management system 404 may be in direct electronic communication with each other. For example, CEW 401 may be in direct communication with electronic device 403; electronic device 403 may be in direct communication with CEW 401 and/or record management system 404; and/or the like.

In various embodiments, network 402 may be configured to enable electronic communications between one or more systems or devices of CEW ecosystem 400. For example, network 402 may enable respective electronic communication between each of CEW 401, electronic device 403, and record management system 404. In that respect, network 402 may comprise any communication channel capable of enabling long-range communications or short-range communications. For example, network 402 may enable electronic communications through one or more communication channels such as a telephone network, a cellular network, an extranet, an intranet, the internet, a wireless communication, a wireless personal area network (WPAN), a local area network (LAN), a wide area network (WAN), a virtual private network (VPN), and/or the like.

In various embodiments, one or more of the communication channels enabling electronic communications in network 402 may be unsecure. Electronic communications disclosed herein via network 402 may utilize data encryption. Encryption may be performed by way of any of the techniques now available in the art or which may become available. Network communications may also incorporate SHA series cryptographic methods, elliptic-curve cryptography (e.g., ECC, ECDH, ECDSA, etc.), and/or other post-quantum cryptography algorithms under development. In various embodiments, electronic communications (and/or individual data in an electronic communication) may also be digitally signed, or may include any other security control.

For the sake of brevity, conventional data networking, application development, and other functional aspects of system may not be described in detail herein. Furthermore, the connecting lines shown in the various figures contained herein are intended to represent exemplary functional relationships and/or electronic communications between the various CEW ecosystem 400 components. Many alternative or additional functional relationships or electronic communications may be present in a practical system or ecosystem.

In various embodiments, CEW 401 may be similar to any other CEW disclosed herein (e.g., CEW 1, with brief reference to FIGS. 1 and 2). For the sake of brevity, redundant characteristics or elements of a CEW described herein may be omitted in describing CEW 401 below. CEW 401 may be configured to deploy, or cause deployment of, one or more projectiles. CEW 401 may also be configured to transmit and/or receive data and/or instructions, as discussed further herein.

In various embodiments, electronic device 403 may comprise, or be in electronic communication with, a computing device such as a server, a computer-based system, a portable computer-based system (e.g., a laptop, a notebook, a hand held computer, a tablet, a personal digital assistant, etc.), a cellular phone, a smart phone (e.g., IPHONE®, ANDROID®, etc.), a wearable device (e.g., a smart watch, smart glasses, a body-worn camera, etc.), an internet of things (IoT) device, and/or any other device capable of transmitting and/or receiving data over a network.

Electronic device 403 may comprise one or more software and/or hardware components. For example, electronic device 403 may comprise hardware such as a processing unit, a communications unit, a memory unit, an input device, and/or an output device. Electronic device 403 may comprise software configured to manage and/or interact with the hardware components, such as, for example, an operating system, user interfaces, software applications, and/or the like.

Electronic device 403 may be configured to transmit and/or receive data, perform calculations on or regarding the data, transmit and/or receive instructions, and/or the like, as discussed further herein. In some embodiments, electronic device 403 may act as an intermediary device between CEW 401 and record management system 404. For example, electronic device 403 may receive data from CEW 401 and transmit data to record management system 404. Electronic device 403 may also receive data from record management system 404 and transmit the data to CEW 401.

In various embodiments, record management system 404 may be configured to receive, provide, manage, and/or store record data. Record management system 404 may include at least one computing device in the form of a computer or processor, or a set of computers or processors, although other types of computing units or systems may be used, such as, for example, a processing circuit, a server, web server, pooled servers, or the like. Record management system 404 may comprise a database management system (DBMS) configured to define, manipulate, retrieve, and manage data in a database or data structure. Record management system 404 may comprise a record database 405 configured to store and maintain the record data. Record database 405 may comprise any suitable database, data structure, or the like capable of storing and maintaining data. Record database 405 may store and maintain the record data using any suitable process. Record management system 404 may be in electronic communication with one or more devices or components of CEW ecosystem 400.

In various embodiments, record management system 404 may be an evidence management system. An evidence management system receives, provides, manages, and/or stores evidence. An evidence management system may store evidence received by a responder agency (e.g., an agency associated with the emergency responder), a receiver agency (e.g., an agency associated with the emergency receiver), and/or the like. For example, in a practical application the evidence management system may store evidence received from a law enforcement agency. The evidence may include any type of data including text, audio, image, and/or video. The evidence may be stored on servers or databases (e.g., record database 405) and accessed via a network. An evidence management system may include a server to perform the functions of an evidence management system. The server may include one or more servers and/or computing devices. The server may control other electronic devices to perform the functions of an evidence management system. The server may include engines and data stores which operate to store and process data and metadata received from systems and devices in CEW ecosystem 400. In various embodiments, record management system 404 may comprise a cloud-based distributed evidence management system, such as, for example, AXON EVIDENCE offered by Axon Enterprise, Inc.

In various embodiments, record management system 404 may be a compliance, workflow, evidence, and/or reporting system, such as, for example, AXON RECORDS offered by Axon Enterprise, Inc.

Figure 5:
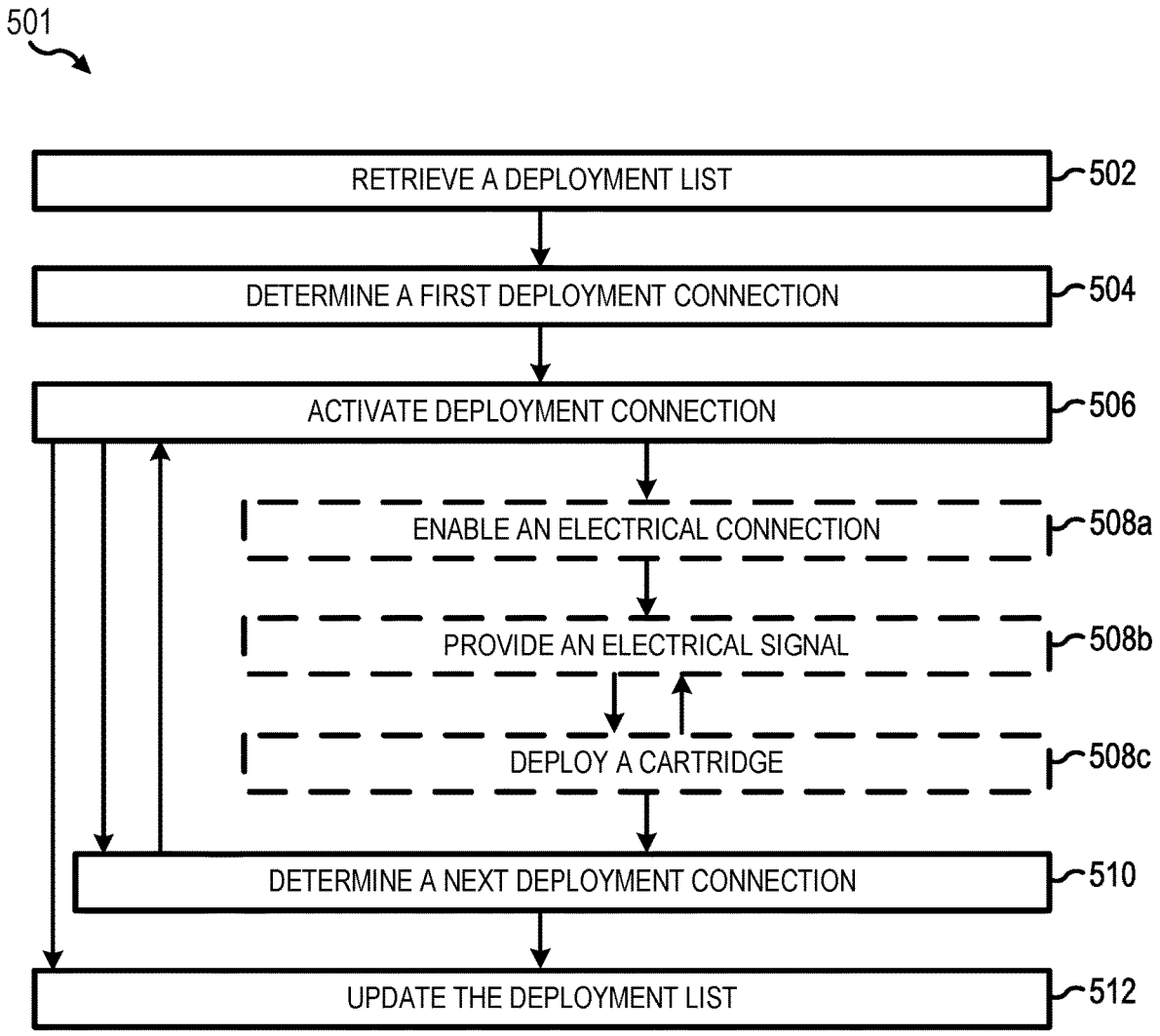
FIG. 5 is a process flow for a method of determining a deployment order from a CEW, in accordance with various embodiments.
Figure 6:
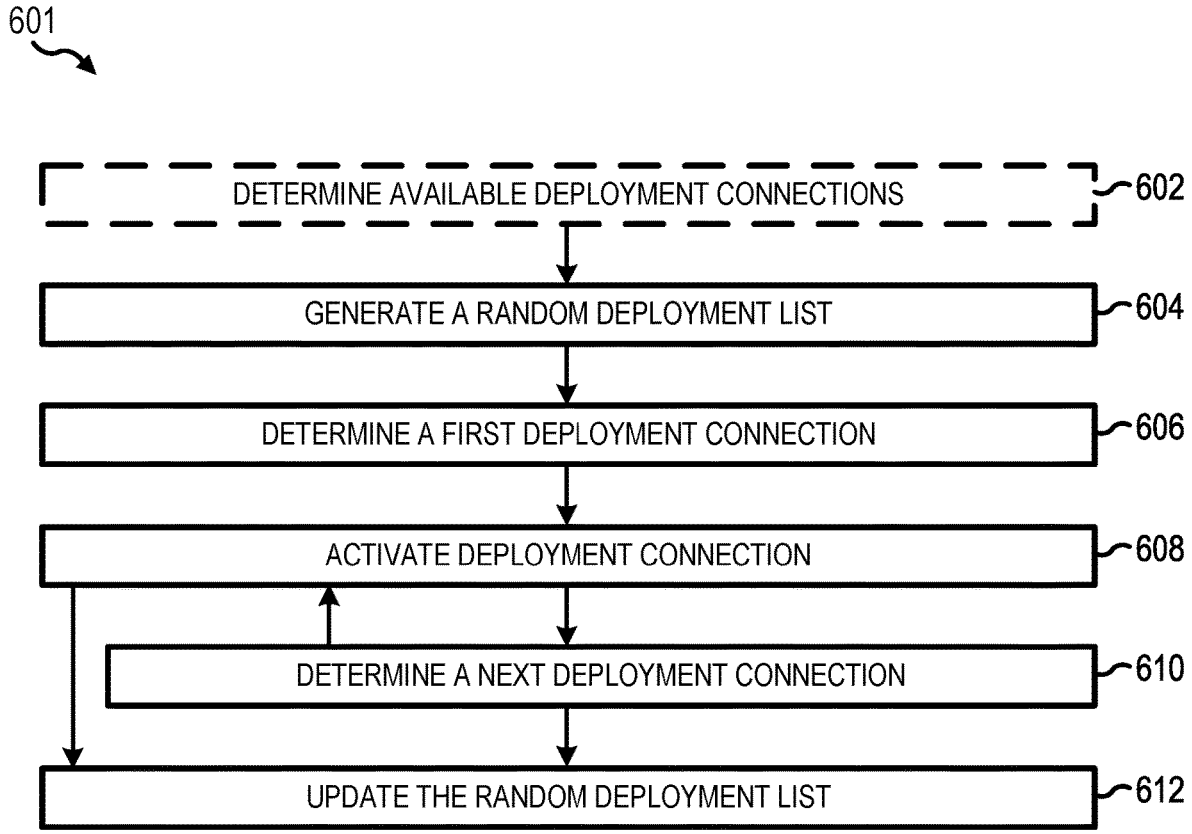
FIG. 6 is a process flow for a method of determining a random deployment order from a CEW, in accordance with various embodiments.
Figure 7:
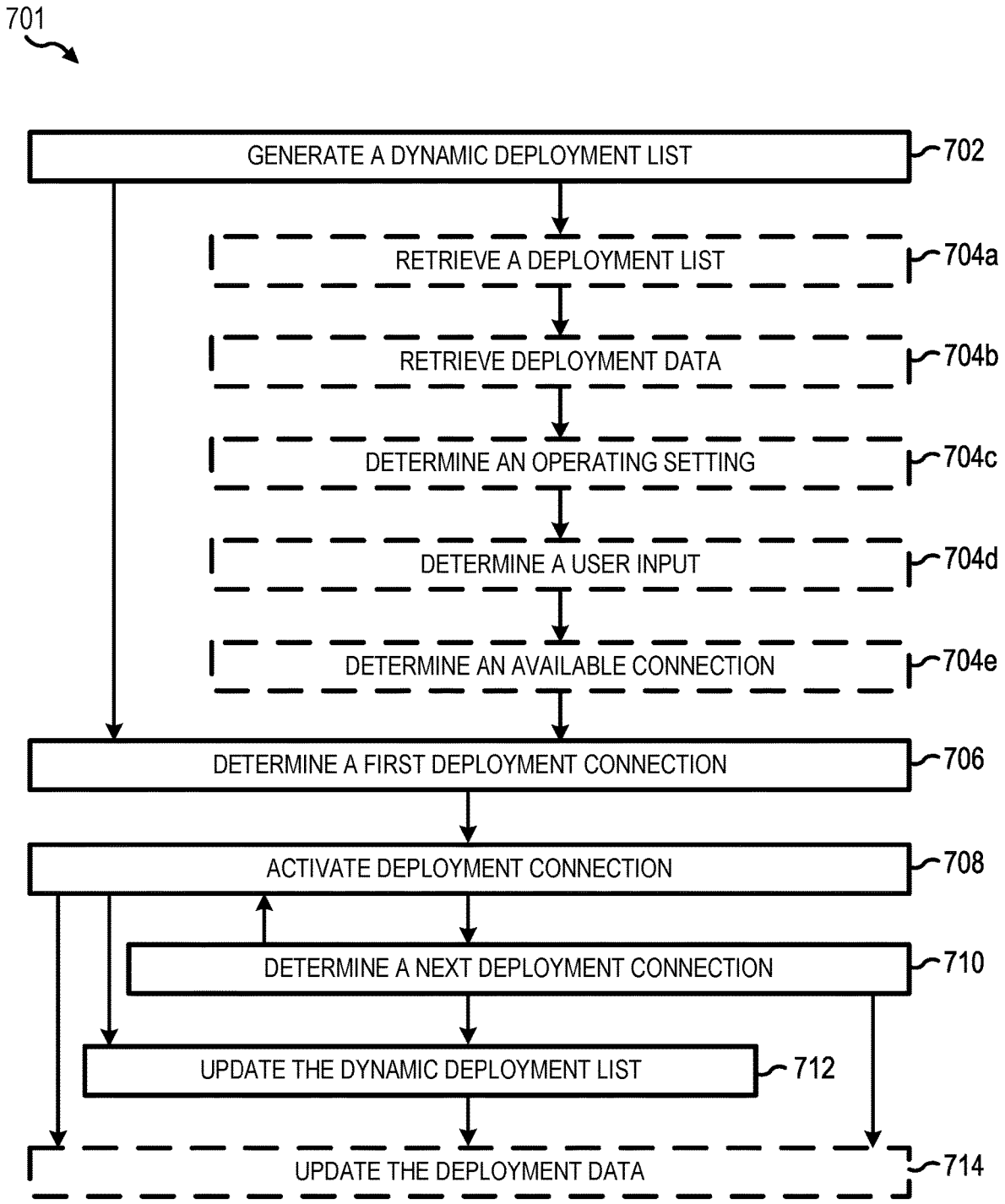
FIG. 7 is a process flow for a method of determining a dynamic deployment order from a CEW, in accordance with various embodiments.

Referring now to FIGS. 5-7, the process flows depicted are merely embodiments and are not intended to limit the scope of the disclosure. For example, the steps recited in any of the method or process descriptions may be executed in any order and are not limited to the order presented. It will be appreciated that the following description makes appropriate references not only to the steps depicted in FIGS. 5-7, but also to the various device and system components as described above with reference to FIGS. 1-4 (or below, with reference to FIG. 8).

In various embodiments, and with specific reference to FIG. 5, a method 501 for determining a deployment order from a conducted electrical weapon (CEW) is disclosed. In some embodiments, method 501 may be performed by a device, such as a handle for a CEW, an electronic device, a server, a computer-based system, or the like (collectively referred to below as a "system").

A system may retrieve a deployment list (step 502). The deployment list may define a deployment order for deployment connections of a conducted electrical weapon. As previously discussed, a deployment connection may refer to one or more components between a CEW handle, a magazine, and a cartridge configured to allow and enable deployment of a cartridge.

For example, a deployment connection may refer to one or more electrical connections of the CEW handle (e.g., a first electrical connection). The electrical connections of the CEW handle may electrically couple the CEW handle to the magazine and/or one or more cartridges of the magazine. In that regard, the electrical connection may provide one or more electrical signals from the CEW handle (e.g., a signal generator of the CEW handle) to the magazine and/or cartridges. For example, an electrical connection may be configured to provide an ignition signal and/or a stimulus signal to the magazine and/or cartridge. The ignition signal may cause the cartridge to deploy a projectile, as previously discussed herein.

For example, a deployment connection may refer to one or more bores of the magazine. Each magazine bore may be configured to receive a cartridge, as previously discussed herein. In response to a magazine being coupled to the CEW handle, each bore of the magazine may be aligned with an electrical connection of the CEW handle. In that respect, a cartridge loaded into a bore of the magazine may be aligned with and electrically coupled to an electrical connection of the CEW handle, in response to the magazine being coupled to the CEW handle.

As a further example, a deployment connection may refer to one or more cartridges loaded into bores of a magazine. Each cartridge may be inserted into (e.g., loaded) a bore of the magazine. In response to the magazine being coupled to the CEW handle, the cartridge may be electrically coupled to an electrical connection of the CEW handle.

In some embodiments, a deployment connection may refer collectively to associated components such as an electrical connection, an aligned bore, and/or a cartridge disposed within the aligned bore. For example, a first deployment connection may comprise one or more of a first bore, a first cartridge in the first bore, and/or a first electrical connection; a second deployment connection may comprise one or more of a second bore, a second cartridge in the second bore, and/or a second electrical connection; and/or the like. Although referred to collectively as a deployment connection, the following discussion can be applied to the collective components and/or to each individual component of a deployment connection, such as for distributing deployments across different bores, distributing deployments across different cartridges, and/or distributing deployments across different electrical connections.

The system may retrieve the deployment list from memory. For example, the system may retrieve the deployment list from memory of a CEW handle. The system may retrieve the deployment list from memory of an electronic device. The system may retrieve the deployment list from memory of a record management system, a server, and/or any other networked resource.

A system may determine a first deployment connection (step 504) based on the deployment list. For example, the deployment list may comprise a marker indicating the last deployment connection used by the CEW handle for a deployment or a next deployment connection to be used for a deployment. Based on the marker of the deployment list, the system may determine the first deployment connection to be used for a deployment.

A system may activate a deployment connection (step 506). In some embodiments, the first deployment connection may be associated with a first electrical connection, a first bore of a magazine, and a first cartridge. The system may activate the first deployment connection responsive to a deployment instruction. For example, a CEW handle may receive a trigger activation. The trigger activation may be received by a trigger of the CEW handle. A processing circuit of the CEW handle may be configured to detect the trigger activation received by the trigger. As a further example, in response to receiving the trigger activation the trigger may transmit the trigger activation to the processing circuit.

In response to receiving the trigger activation, the system may activate the first deployment connection. The system may activate the first deployment connection using any suitable process. Activating a deployment connection may include one or more of establishing an electrical path between one or more components of the CEW handle and one or more cartridges, causing deployment of one or more cartridges, providing a stimulus signal through deployed projectiles of the one or more cartridges, and/or the like, as discussed further herein.

In various embodiments, the system may activate the first deployment connection by enabling an electrical connection (step 508*a*). The first electrical connection may define an electrical path between a CEW handle and one or more cartridges in a magazine coupled to the CEW handle. In some embodiments, the first electrical connection may define an electrical path between the CEW handle and one cartridge (e.g., a first cartridge) in the magazine. The first cartridge may be loaded into a first bore of the magazine. In some embodiments, the first electrical connection may define a plurality of electrical paths, with each electrical path between the CEW handle and one or more separate cartridges in the magazine. Each of the cartridges may be loaded into different bores within the magazine. The electrical path may be established by opening or closing electrical switches, and/or using any other process known in the art. In some embodiments, a processing circuit of the CEW handle may enable the electrical connection.

In various embodiments, the system may activate the deployment connection by providing an electrical signal (step 508*b*). The electrical signal may be provided via the electrical connection established in step 508*a*. For example, an electrical signal may be provided from the signal generator through the first electrical connection and to the first cartridge. The processing circuit of the CEW handle and/or the signal generator may control provision of the electrical signal. The electrical signal may comprise an ignition signal and/or a stimulus signal. The ignition signal may be configured to cause deployment of a projectile from the first cartridge. The stimulus signal may be provided from the signal generator to the cartridge and through the deployed projectile of the cartridge. In some embodiments, the ignition signal and the stimulus signal may comprise a same electrical signal. In some embodiments, the ignition signal and the stimulus signal may comprise separate electrical signals.

In various embodiments, the system may activate the first deployment connection by deploying a cartridge (step 508*c*). For example, the processing circuit may instruct and/or cause deployment of the cartridge. As discussed in step 508*b*, an ignition signal may be provided through the first deployment connection to cause deployment of a projectile from the first cartridge.

In various embodiments, a system may test a deployment connection before activating the deployment connection. For example, the CEW handle may test the deployment connection by detecting whether the deployment connection has an available cartridge. In response to the deployment connection having an available cartridge, the CEW handle may proceed with activating the deployment connection. In response to the deployment connection not having an available cartridge, the CEW handle may skip the deployment connection and proceed to step 512.

For example, in some embodiments, a deployment connection may not be available for deployment if no cartridge is loaded into the associated magazine bore, if the cartridge in the associated magazine bore is spent or defective, if the cartridge loaded into the associated magazine bore is incompatible, and/or the like. A CEW handle may detect whether the deployment connection is available using any suitable process. For example, in some embodiments the CEW handle may transmit an electrical signal (e.g., a low voltage signal) through the electrical connection of the deployment connection. The electrical signal may be configured to complete an electrical circuit without causing deployment of a cartridge of the deployment connection. In response to the CEW handle detecting that the electrical circuit is complete, the associated deployment connection may be available. In response to the CEW handle detecting that the electrical circuit is not complete (e.g., an open circuit), the associated deployment connection may not be available.

A system may update the deployment list (step 512) based on activating the first deployment connection. For example, the system may update the deployment list by moving a marker of the deployment list. In some embodiments, the marker may be moved to the next sequential deployment connection in the deployment list to indicate the next deployment connection. In some embodiments, the marker may be moved to the first deployment connection to indicate the last activated or tested deployment connection. The processing circuit of the CEW handle may update the deployment list. In some embodiments, the system may save the updated deployment list in memory.

A system may determine a next deployment connection (step 510) based on the deployment list. The system may determine the next deployment connection similar to determining the first deployment connection in step 504. For example, the deployment list may comprise a marker indicating the last deployment connection used by the CEW handle for a deployment or a next deployment connection to be used for a deployment. Based on the marker of the deployment list, the system may determine the next deployment connection to be used for a deployment.

In response to determining the next deployment connection, the system may activate the next deployment connection (repeat step 506). In some embodiments, the next deployment connection may be associated with a next electrical connection, a next bore of a magazine, and a next cartridge. The system may activate the next deployment connection responsive to a deployment instruction. For example, a CEW handle may receive a trigger activation, as previously discussed. In various embodiments, in response to determining the next deployment connection, the system may test the next deployment connection before activating the deployment connection, as previously discussed herein. In response to activating the next deployment connection and/or testing the next deployment connection, the system may update the deployment list (repeat step 512). In some embodiments, the system may save the updated deployment list in memory.

In some embodiments, determining the first deployment connection, activating the first deployment connection, and updating the deployment list may occur during a first activation event, and determining the next deployment connection, activating the next deployment connection, and updating the deployment list may occur during a second activation event. In some embodiments, determining the first deployment connection, activating the first deployment connection, and updating the deployment list and determining the next deployment connection, activating the next deployment connection, and updating the deployment list may all occur during a first activation event. In that regard, the deployment list may maintain a sequential ordering of deployments regardless of whether the deployments occur across a single activation event, or multiple activation events.

In various embodiments, the system may repeat determining a next deployment connection (step 510), activating the next deployment connection (step 506), and updating the deployment list (step 512), based on the deployment list. For example, a CEW handle may repeat the steps 510, 506, and 512 for each deployment during an activation event. As a further example, during a next activation event the CEW handle may begin method 501 by retrieving the deployment list at step 502.

In various embodiments, and with specific reference to FIG. 6, a method 601 for determining a random deployment order from a conducted electrical weapon (CEW) is disclosed. Method 601 may be performed by a device, such as a handle for a CEW, an electronic device, a server, a computer-based system, or the like (collectively referred to below as a "system").

In various embodiments, a system may determine available connections (step 602). For example, a CEW handle may test each deployment connection to determine whether the deployment connection is available (e.g., capable) of deploying a cartridge. The CEW handle may test the deployment connection by detecting whether each deployment connection has an available cartridge. For example, in some embodiments, a deployment connection may not be available for deployment if no cartridge is loaded into the associated magazine bore, if the cartridge in the associated magazine bore is spent or defective, if the cartridge loaded into the associated magazine bore is incompatible, and/or the like. A CEW handle may detect whether the deployment connection is available using any suitable process. For example, in some embodiments the CEW handle may transmit an electrical signal (e.g., a low voltage signal) through the electrical connection of the deployment connection. The electrical signal may be configured to complete an electrical circuit without causing deployment of a cartridge of the deployment connection. In response to the CEW handle detecting that the electrical circuit is complete, the associated deployment connection may be available. In response to the CEW handle detecting that the electrical circuit is not complete (e.g., an open circuit), the associated deployment connection may not be available.

In various embodiments, a CEW handle may determine available connections by detecting a number of bores of a magazine coupled to the CEW handle. For example, the CEW handle may query the magazine to determine the number of bores. As a further example, the CEW handle may determine a magazine identifier associated with the magazine. The CEW handle may determine the number of bores based on the magazine identifier.

A system may generate a random deployment list (step 604). The random deployment list may comprise a randomly generated deployment order for deployment connections of the CEW. The random deployment list may be generated before or with an activation event, and/or at any other suitable interval. The system may generate the random deployment list using any suitable process. In some embodiments, the random deployment list may be generated to comprise a randomly ordered list of each deployment connection of the CEW. In some embodiments, the random deployment list may be generated to exclude deployment connections of the CEW that are unavailable, as determined in step 602. In that regard, the random deployment list may comprise a randomly ordered list of only the available deployment connection of the CEW.

A system may determine a first deployment connection based on the random deployment list (step 606). The system may determine the first deployment connection similar to determining the first deployment connection in step 504, with brief reference to FIG. 5. For example, the random deployment list may comprise a marker indicating a deployment connection to be used for a deployment. Based on the marker of the deployment list, the system may determine the first deployment connection to be used for a deployment.

A system may activate the first deployment connection (step 608). The system may activate the first deployment connection similar to activating the first deployment connection in step 506 (and/or steps 508*a*, 508*b*, and 508*c*), with brief reference to FIG. 5. For example, in some embodiments, the first deployment connection may be associated with a first electrical connection, a first bore of a magazine, and a first cartridge (e.g., as defined by the random deployment list). The system may activate the first deployment connection responsive to a deployment instruction. For example, a CEW handle may receive a trigger activation. The trigger activation may be received by a trigger of the CEW handle. A processing circuit of the CEW handle may be configured to detect the trigger activation received by the trigger. As a further example, in response to receiving the trigger activation the trigger may transmit the trigger activation to the processing circuit. In response to receiving the trigger activation, the system may activate the first deployment connection. The system may activate the first deployment connection using any suitable process. Activating a deployment connection may include one or more of establishing an electrical path between one or more components of the CEW handle and one or more cartridges, providing an ignition signal to one or more cartridges, causing deployment of one or more cartridges, providing a stimulus signal through deployed projectiles of the one or more cartridges, and/or the like, as discussed further herein.

In various embodiments, a system may test a deployment connection before activating the deployment connection. For example, the CEW handle may test the deployment connection by detecting whether the deployment connection has an available cartridge. In response to the deployment connection having an available cartridge, the CEW handle may proceed with activating the deployment connection. In response to the deployment connection not having an available cartridge, the CEW handle may skip the deployment connection and proceed to step 612.

A system may update the random deployment list (step 612) based on activating the first deployment connection. The system may update the random deployment list similar to updating the deployment list in step 512, with brief reference to FIG. 5. For example, the system may update the random deployment list by moving a marker of the random deployment list. In some embodiments, the marker may be moved to the next sequential deployment connection in the deployment list to indicate the next deployment connection. In some embodiments, the marker may be moved to the first deployment connection to indicate the last activated or tested deployment connection. The processing circuit of the CEW handle may update the random deployment list. In some embodiments, the system may save the updated random deployment list in memory.

A system may determine a next deployment connection (step 610). The system may determine the next deployment connection similar to determining the first deployment connection in step 606. The system may determine the next deployment connection similar to determining the first deployment connection in step 504 and/or determining the next deployment connection in step 510, with brief reference to FIG. 5. For example, the random deployment list may comprise a marker indicating the last deployment connection used by the CEW handle for a deployment or a next deployment connection to be used for a deployment. Based on the marker of the random deployment list, the system may determine the next deployment connection to be used for a deployment.

In response to determining the next deployment connection, the system may activate the next deployment connection (repeat step 608). In some embodiments, the next deployment connection may be associated with a next electrical connection, a next bore of a magazine, and a next cartridge. The system may activate the next deployment connection responsive to a deployment instruction. For example, a CEW handle may receive a trigger activation, as previously discussed. In various embodiments, in response to determining the next deployment connection, the system may test the next deployment connection before activating the deployment connection, as previously discussed herein. In response to activating the next deployment connection and/or testing the next deployment connection, the system may update the random deployment list (repeat step 612). In some embodiments, the system may save the updated random deployment list in memory.

In various embodiments, a system may generate the random deployment list (step 604) before or with an activation event. The system may generate the random deployment list before or with each activation event. The system may generate the random deployment list at intervals of activation events or time. For example, the system may generate a random deployment list at time intervals, such as once a month, once a quarter, once a year, etc. The system may generate a random deployment list at activation event intervals, such as before every fifth activation event, before every tenth activation event, etc. The system may generate a random deployment list based on a user input (e.g., a user request to generate a random deployment list). In such embodiments, a marker may be used by the CEW handle to update the random deployment list between intervals.

In some embodiments, determining the first deployment connection, activating the first deployment connection, and updating the random deployment list may occur during a first activation event, and determining the next deployment connection, activating the next deployment connection, and updating the random deployment list may occur during a second activation event. In some embodiments, determining the first deployment connection, activating the first deployment connection, and updating the random deployment list and determining the next deployment connection, activating the next deployment connection, and updating the random deployment list may all occur during a first activation event. In that regard, the deployment list may maintain a sequential ordering of deployments regardless of whether the deployments occur across a single activation event, or multiple activation events.

In various embodiments, the system may repeat determining a next deployment connection (step 610), activating the next deployment connection (step 608), and updating the random deployment list (step 612), based on the random deployment list. For example, a CEW handle may repeat the steps 610, 608, and 612 for each deployment during an activation event. As a further example, during a next activation event the CEW handle may begin method 601 by generating a new random deployment list at step 604 and/or first by determining available deployment connections at step 602.

In various embodiments, and with specific reference to FIG. 7, a method 701 for dynamically determining a dynamic deployment order from a conducted electrical weapon (CEW) is disclosed. Method 701 may be performed by a device, such as a handle for a CEW, an electronic device, a server, a computer-based system, or the like (collectively referred to below as a "system").

A system may generate a dynamic deployment list (step 702). The dynamic deployment list may comprise a dynamically generated deployment order for deployment connections of the CEW. The dynamic deployment list may be generated before or with an activation event, and/or at any other suitable interval. The system may generate the dynamic deployment list using any suitable process. The dynamic deployment list may be generated based on data associated with the CEW handle, the magazine, and/or cartridges of the magazine. For example, the dynamic deployment list may be generated based on data comprising deployment data, an operating setting, a user input, an available connection, and/or the like.

In various embodiments, the system may retrieve a deployment list (step 704*a*). The deployment list may define an initial listing of a deployment order prior to generation of the dynamic deployment list. The system may retrieve the deployment list similar to retrieving the deployment list in step 502, with brief reference to FIG. 5. For example, the system may retrieve the deployment list from memory. The system may retrieve the deployment list from memory of a CEW handle. The system may retrieve the deployment list from memory of an electronic device. The system may retrieve the deployment list from memory of a record management system, a server, and/or any other networked resource.

In various embodiments, the system may retrieve deployment data (step 704*b*). Deployment data may include data regarding deployments of deployment connections of the handle, as previously discussed herein. For example, deployment data may include handle deployment data, magazine deployment data, cartridge deployment data, and/or the like. The system may retrieve the deployment data using any suitable process. For example, the system may retrieve the deployment data from memory. The system may retrieve the deployment data from one or more of memory of the CEW handle, memory of the magazine, memory of a cartridge, memory of an electronic device, memory of a networked resource or record management system, and/or the like. The system may retrieve the deployment data by communicating with the magazine and/or the cartridge, such as, for example, by determining the magazine identifier associated with the magazine, the cartridge identifier associated with the cartridge, and/or the like, as previously discussed herein.

In various embodiments, the system may determine an operating setting (step 704*c*). An operating setting may include data regarding settings, characteristics, properties, capabilities, and/or the like of the CEW handle, the magazine, and/or the cartridge, as previously discussed herein. For example, an operating setting may comprise a handle operating setting, a magazine operating setting, and/or a cartridge operating setting. The system may determine the operating setting using any suitable process. For example, the system may retrieve the operating setting from memory. The system may retrieve the operating setting from one or more of memory of the CEW handle, memory of the magazine, memory of a cartridge, memory of an electronic device, memory of a networked resource or record management system, and/or the like. The system may retrieve the operating setting by communicating with the magazine and/or the cartridge, such as, for example, by determining the magazine identifier associated with the magazine, the cartridge identifier associated with the cartridge, and/or the like, as previously discussed herein.

In various embodiments, the system may determine a user input (step 704*d*). A user input may include data regarding user preferences, inputs, requests, operations, and/or the like of the CEW handle. For example, the CEW handle may receive an input from a user. The input may be received using any suitable process, as previously discussed herein. For example, the user may interact with a control interface, a user interface, and/or the like of the CEW handle to input the user input. The CEW handle may store the user input in memory. The user input may comprise a handle mode, a cartridge selection, a deployment selection, and/or the like.

In various embodiments, the system may determine an available connection (step 704*e*). The system may determine an available deployment connection using any suitable process. The system may determine an available deployment connection similar to determining the available connections in step 602, with brief reference to FIG. 6, and/or similar to testing a deployment connection as described in step 506, with brief reference to FIG. 5. For example, a CEW handle may determine an available connection by testing each deployment connection to determine whether the deployment connection is available (e.g., capable) of deploying a cartridge. The CEW handle may test a deployment connection by detecting whether each deployment connection has an available cartridge. For example, in some embodiments, a deployment connection may not be available for deployment if no cartridge is loaded into the associated magazine bore, if the cartridge in the associated magazine bore is spent or defective, if the cartridge loaded into the associated magazine bore is incompatible, and/or the like. A CEW handle may detect whether the deployment connection is available using any suitable process. For example, in some embodiments the CEW handle may transmit an electrical signal (e.g., a low voltage signal) through the electrical connection of the deployment connection. The electrical signal may be configured to complete an electrical circuit without causing deployment of a cartridge of the deployment connection. In response to the CEW handle detecting that the electrical circuit is complete, the associated deployment connection may be available. In response to the CEW handle detecting that the electrical circuit is not complete (e.g., an open circuit), the associated deployment connection may not be available.

In various embodiments, a CEW handle may determine available connections by detecting a number of bores of a magazine coupled to the CEW handle. For example, the CEW handle may query the magazine to determine the number of bores. As a further example, the CEW handle may determine a magazine identifier associated with the magazine. The CEW handle may determine the number of bores based on the magazine identifier.

The system may generate the dynamic deployment list based on one or more of the deployment list, the deployment data, the operating setting, the user input, and/or the available connections. As discussed further herein, the system may weight and/or prioritize one or more of the deployment list, the deployment data, the operating setting, the user input, and/or the available connections when generating the dynamic deployment list.

A system may determine a first deployment connection based on the dynamic deployment list (step 706). The system may determine the first deployment connection similar to determining the first deployment connection in step 504, with brief reference to FIG. 5, and/or similar to determining the first deployment connection in step 606, with brief reference to FIG. 6. For example, the dynamic deployment list may comprise a marker indicating a deployment connection to be used for a deployment. Based on the marker of the dynamic deployment list, the system may determine the first deployment connection to be used for a deployment.

A system may activate the first deployment connection (step 708). The system may activate the first deployment connection similar to activating the first deployment connection in step 506 (and/or steps 508*a*, 508*b*, and 508*c*) in step 506, with brief reference to FIG. 5, and/or similar to activating the first deployment connection in step 608, with brief reference to FIG. 6. For example, in some embodiments, the first deployment connection may be associated with a first electrical connection, a first bore of a magazine, and a first cartridge (e.g., as defined by the dynamic deployment list). The system may activate the first deployment connection responsive to a deployment instruction. For example, a CEW handle may receive a trigger activation. The trigger activation may be received by a trigger of the CEW handle. A processing circuit of the CEW handle may be configured to detect the trigger activation received by the trigger. As a further example, in response to receiving the trigger activation the trigger may transmit the trigger activation to the processing circuit. In response to receiving the trigger activation, the system may activate the first deployment connection. The system may activate the first deployment connection using any suitable process. Activating a deployment connection may include one or more of establishing an electrical path between one or more components of the CEW handle and one or more cartridges, providing an ignition signal to one or more cartridges, causing deployment of one or more cartridges, providing a stimulus signal through deployed projectiles of the one or more cartridges, and/or the like, as discussed further herein.

In various embodiments, a system may test a deployment connection before activating the deployment connection. For example, the CEW handle may test the deployment connection by detecting whether the deployment connection has an available cartridge. In response to the deployment connection having an available cartridge, the CEW handle may proceed with activating the deployment connection. In response to the deployment connection not having an available cartridge, the CEW handle may skip the deployment connection and proceed to step 712.

A system may update the dynamic deployment list (step 712) based on activating the first deployment connection. The system may update the dynamic deployment list similar to updating the deployment list in step 512, with brief reference to FIG. 5, and/or similar to updating the deployment list in step 612, with brief reference to FIG. 6.

For example, the system may update the dynamic deployment list by moving a marker of the dynamic deployment list. In some embodiments, the marker may be moved to the next sequential deployment connection in the dynamic deployment list to indicate the next deployment connection. In some embodiments, the marker may be moved to the first deployment connection to indicate the last activated or tested deployment connection in the dynamic deployment list. The processing circuit of the CEW handle may update the dynamic deployment list. In some embodiments, the system may save the updated dynamic deployment list in memory.

In various embodiments, a system may update the deployment data (step 714) based on activating the first deployment connection. The deployment data associated with the first deployment connection may be updated based on activating the first deployment connection. For example, responsive to a first deployment at a first deployment connection, the deployment count for the components and connections associated with the first deployment connection may be increased by one. As a further example, responsive to the first deployment connection being unable to activate, the deployment count for the components and connections associated with the first deployment connection may not be updated or be increased by zero. As a further example, the deployment data may be variably updated. Responsive to a first deployment at a first deployment connection, the deployment count for the components and connections associated with the first deployment connection may be variably updated, as discussed further herein. The CEW handle may update and save the deployment data in memory.

A system may determine a next deployment connection (step 710). The system may determine the next deployment connection similar to determining the first deployment connection in step 706. The system may determine the next deployment connection similar to determining the first deployment connection in step 504 and/or determining the next deployment connection in step 510, with brief reference to FIG. 5, and/or similar to determining the first deployment connection in step 606 and/or determining the next deployment connection in step 610, with brief reference to FIG. 6. For example, the dynamic deployment list may comprise a marker indicating the last deployment connection used by the CEW handle for a deployment or a next deployment connection to be used for a deployment. Based on the marker of the dynamic deployment list, the system may determine the next deployment connection to be used for a deployment.

In response to determining the next deployment connection, the system may activate the next deployment connection (repeat step 708). In some embodiments, the next deployment connection may be associated with a next electrical connection, a next bore of a magazine, and a next cartridge. The system may activate the next deployment connection responsive to a deployment instruction. For example, a CEW handle may receive a trigger activation, as previously discussed. In various embodiments, in response to determining the next deployment connection, the system may test the next deployment connection before activating the deployment connection, as previously discussed herein. In response to activating the next deployment connection and/or testing the next deployment connection, the system may update the dynamic deployment list (repeat step 712). In some embodiments, the system may save the updated dynamic deployment list in memory. In various embodiments, the system may update the deployment data responsive to activating the next deployment connection (repeat step 714). The system may save the updated deployment data in memory.

In various embodiments, a system may generate the dynamic deployment list (step 702) before or with an activation event. The system may generate the dynamic deployment list before or with each activation event. The system may generate the dynamic deployment list at intervals of activation events or time. For example, the system may generate a dynamic deployment list at time intervals, such as once a month, once a quarter, once a year, etc. The system may generate a dynamic deployment list at activation event intervals, such as before every fifth activation event, before every tenth activation event, etc. The system may generate a dynamic deployment list based on a user input (e.g., a user request to generate a dynamic deployment list). In such embodiments, a marker may be used by the CEW handle to update the dynamic deployment list between intervals.

In some embodiments, determining the first deployment connection, activating the first deployment connection, updating the dynamic deployment list, and/or updating the deployment data may occur during a first activation event, and determining the next deployment connection, activating the next deployment connection, updating the dynamic deployment list, and/or updating the deployment data may occur during a second activation event. In some embodiments, determining the first deployment connection, activating the first deployment connection, updating the dynamic deployment list, and/or updating the deployment data and determining the next deployment connection, activating the next deployment connection, updating the dynamic deployment list, and/or updating the deployment data may all occur during a first activation event.

In various embodiments, the system may repeat determining a next deployment connection (step 710), activating the next deployment connection (step 708), updating the dynamic deployment list (step 712), and/or updating the deployment data (step 714) based on the dynamic deployment list. For example, a CEW handle may repeat the steps 710, 708, 712, and/or 714 for each deployment during an activation event. As a further example, during a next activation event the CEW handle may begin method 701 by generating a new dynamic deployment list at step 702.

Figure 8:
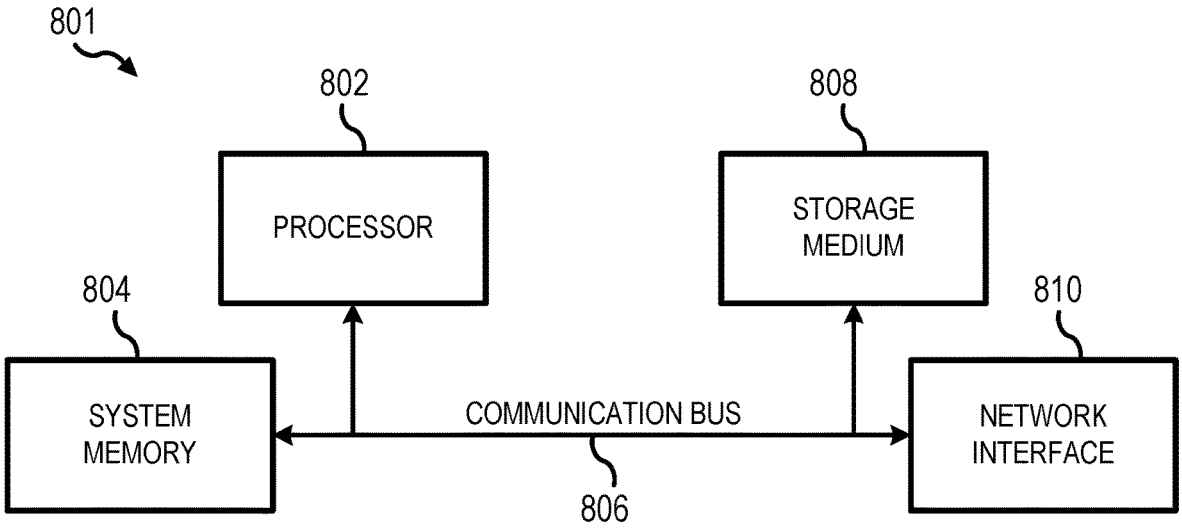
FIG. 8 is a block diagram illustrating components of a computer-based system, in accordance with various embodiments.

In various embodiments, and with reference to FIG. 8, an exemplary computer-based system 801 is disclosed. Computer-based system 801 may be appropriate for use in accordance with embodiments of the present disclosure. The accompanying description of computer-based system 801 may be applicable to servers, personal computers, mobile phones, smart phones, tablet computers, embedded computing devices, and other currently available or yet-to-be-developed devices that may be used in accordance with embodiments of the present disclosure.

Computer-based system 801 may include a processor 802 and a system memory 804 connected by a communication bus 806. Depending on the exact configuration and type of computer-based system, system memory 804 may be volatile or nonvolatile memory, such as read only memory ("ROM"), random access memory ("RAM"), EEPROM, flash memory, or other memory technology. Those of ordinary skill in the art and others will recognize that system memory 804 typically stores data and/or program modules that are immediately accessible to and/or currently being operated on by processor 802. In this regard, processor 802 may serve as a computational center of computer-based system 801 by supporting the execution of instructions. Processor 802 may comprise one or more processing units, as discussed further herein. System memory 804 may comprise one or more memory units, as discussed further herein.

Computer-based system 801 may include a network interface 810 comprising one or more components for communicating with other devices and systems over a network. Embodiments of the present disclosure may access basic services that utilize network interface 810 to perform communications using common network protocols. Network interface 810 may comprise a communications unit, as discussed further herein.

Computer-based system 801 may also include a storage medium 808. However, services may be accessed using a computer-based system that does not include means for persisting data to a local storage medium. Therefore, storage medium 808 depicted in FIG. 8 is optional. Storage medium 808 may be volatile or nonvolatile, removable or nonremovable, implemented using any technology capable of storing information such as, but not limited to, a hard drive, solid state drive, CD-ROM, DVD, or other disk storage, magnetic tape, magnetic disk storage, and/or the like. Storage medium 808 may include one or more memory units, as discussed further herein.

As used herein, the term "computer-readable medium" includes volatile and nonvolatile and removable and nonremovable media implemented in any method or technology capable of storing information, such as computer-readable instructions, data structures, program modules, or other data. In this regard, system memory 804 and storage medium 808 depicted in FIG. 8 are examples of computer-readable media.

For ease of illustration and because it is not important for an understanding of the claimed subject matter, FIG. 8 does not show some of the typical components of many computer-based systems. In this regard, computer-based system 801 may include input devices, such as a keyboard, keypad, mouse, trackball, microphone, video camera, touchpad, touchscreen, electronic pen, stylus, and/or any other input device described herein. Such input devices may be coupled to computer-based system 801 by wired or wireless connections including RF, infrared, serial, parallel, BLUETOOTH®, USB, or other suitable connection protocols using wireless or physical connections.

In any of the described examples, data can be captured by input devices and transmitted or stored for future processing. The processing may include encoding data streams, which can be subsequently decoded for presentation by output devices. Media data can be captured by multimedia input devices and stored by saving media data streams as files on a computer-readable storage medium (e.g., in memory or persistent storage on a client device, server, administrator device, or some other device). Input devices can be separate from and communicatively coupled to computer-based system 801 (e.g., a client device), or can be integral components of computer-based system 801. In some embodiments, multiple input devices may be combined into a single, multifunction input device (e.g., a video camera with an integrated microphone).

Computer-based system 801 may also include output devices such as a display, speakers, printer, and/or any other output device described herein. The output devices may include video output devices such as a display or touchscreen. The output devices also may include audio output devices such as external speakers or earphones. The output devices can be separate from and communicatively coupled to computer-based system 801, or can be integral components of computer-based system 801. Input functionality and output functionality may be integrated into the same input/output device (e.g., a touchscreen). Any suitable input device, output device, or combined input/output device either currently known or developed in the future may be used with described systems.

In various embodiments, a "processing unit" as described herein may comprise any suitable hardware and/or software-based processing component. For example, a processing unit may comprise one or more of a processing circuit, a processor, an application specific integrated circuit (ASIC), a controller, a microcontroller, a microprocessor, a programmable logic device, logic circuitry, and/or the like.

In various embodiments, a "communications unit" as described herein may comprise any suitable hardware and/or software components capable of enabling the transmission and/or reception of data. A communications unit may enable electronic communications between devices and systems. A communications unit may enable communications over a network. Examples of a communications unit may include a modem, a network interface (such as an Ethernet card), a communications port, etc. Data may be transferred via a communications unit in the form of signals which may be electronic, electromagnetic, optical, or other signals capable of being transmitted or received by a communications unit. A communications unit may be configured to communicate via any wired or wireless protocol such as a CAN bus protocol, an Ethernet physical layer protocol (e.g., those using 10BASE-T, 100BASE-T, 1000BASE-T, etc.), an IEEE 1394 interface (e.g., FireWire), Integrated Services for Digital Network (ISDN), a digital subscriber line (DSL), an 802.11a/b/g/n/ac signal (e.g., Wi-Fi), a wireless communications protocol using short wavelength UHF radio waves and defined at least in part by IEEE 802.15.1 (e.g., the BLUETOOTH® protocol maintained by Bluetooth Special Interest Group), a wireless communications protocol defined at least in part by IEEE 802.15.4 (e.g., the ZigBee® protocol maintained by the ZigBee alliance), a cellular protocol, an infrared protocol, an optical protocol, or any other protocol capable of transmitting information via a wired or wireless connection.

Two or more of the system components may be in electronic communication via a network. As used herein, the term "network" may further include any cloud, cloud computing system, or electronic communications system or method that incorporates hardware and/or software components. Communication amongst the devices and systems over a network may be accomplished through any suitable communication channel, such as, for example, a telephone network, an extranet, an intranet, the internet, a wireless communication, local area network (LAN), wide area network (WAN), virtual private network (VPN), and/or the like.

Electronic communications between the systems and devices may be unsecure. A network may be unsecure. Electronic communications disclosed herein may utilize data encryption. Encryption may be performed by way of any of the techniques now available in the art or which may become available—e.g., Twofish, RSA, El Gamal, Schorr signature, DSA, PGP, PM, GPG (GnuPG), HPE Format-Preserving Encryption (FPE), Voltage, Triple DES, Blowfish, AES, MDS, HMAC, IDEA, RC6, and symmetric and asymmetric cryptosystems. Network communications may also incorporate SHA series cryptographic methods, elliptic-curve cryptography (e.g., ECC, ECDH, ECDSA, etc.), and/or other post-quantum cryptography algorithms under development.

For the sake of brevity, conventional data networking, application development, and other functional aspects of system may not be described in detail herein. Furthermore, the connecting lines shown in the various figures contained herein are intended to represent exemplary functional relationships and/or electronic communications between the various elements. It should be noted that many alternative or additional functional relationships or electronic communications may be present in a practical system.

In various embodiments, a "memory" or "memory unit" as discussed herein may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Any database discussed herein may include relational, hierarchical, graphical, distributed ledger, blockchain, object-oriented structure, and/or any other database configurations, unless otherwise specified. Any database may also include a flat file structure wherein data may be stored in a single file in the form of rows and columns, with no structure for indexing and no structural relationships between records. For example, a flat file structure may include a delimited text file, a CSV (comma-separated values) file, and/or any other suitable flat file structure. Moreover, a database may be organized in any suitable manner, for example, as data tables or lookup tables. Each record stored in a database may be a single file, a series of files, a linked series of data fields, and/or any other data structure or schema.

Any database, system, device, server, or other components of the system described herein may consist of any combination thereof at a single location or at multiple locations. For example, any database described herein may comprise a single database or a plurality of databases (virtual partitions or physically distinct). Each database or system may include any of various suitable security features, such as firewalls, access codes, encryption, decryption, compression, decompression, and/or the like.

In various embodiments, an "input device" as discussed herein may comprise hardware and/or software used to provide data, inputs, control signals, and the like to a computer-based system, software application, etc. For example, an input device may include a pointing device (e.g., mouse, joystick, pointer, etc.), a keyboard (e.g., virtual or physical), a touchpad or touchscreen interface, a video input device (e.g., camera, scanner, multi-camera system, etc.), a virtual reality system, an audio input device (e.g., microphone, digital musical instrument, etc.), a biometric input device (e.g., fingerprint scanner, iris scanner, etc.), a composite device (e.g., a device having a plurality of different forms of input), and/or any other input device.

In various embodiments, an "output device" as discussed herein may comprise hardware and/or software configured to convert information into a human-accessible form, for display, projection, or physical reproduction. For example, an output device may include a display device (e.g., monitor, monochrome display, colored display, CRT, LCD, LED, projector, video card, etc.), an audio output device (e.g., speaker, headphones, sound card, etc.), a location services system (e.g., global positioning system (GPS), etc.), a printer (e.g., dot matrix printer, inkjet printer, laser printer, 3D printer, wide-format printer, etc.), a braille reader, a composite device (e.g., a device having a plurality of different forms of output), and/or any other output device.

In various embodiments, "satisfy," "meet," "match," "associated with," or similar phrases used herein may include an identical match, a partial match, meeting certain criteria, matching a subset of data, a correlation, satisfying certain criteria, a correspondence, an association, an algorithmic relationship, and/or the like. Similarly, as used herein, "authenticate," "verify," "validate," or similar terms may include an exact authentication, verification, or validation; a partial authentication, verification, or validation; authenticating, verifying, or validating a subset of data; satisfying certain criteria; an association; an algorithmic relationship; and/or the like.

In various embodiments, a method for distributing deployments in a conducted electrical weapon (CEW) is disclosed. The method may include one or more steps. The steps may be executed, completed, and/or the like by a processing circuit. For example, the method may include steps comprising retrieving a deployment list, wherein the deployment list defines a deployment order for a plurality of deployment connections for the conducted electrical weapon; activating a first deployment connection of the plurality of deployment connections based on the deployment order; and updating the deployment list to indicate a next deployment connection of the plurality of deployment connections in the deployment order.

In various embodiments of the above method, the step of activating the first deployment connection may further comprise a step of enabling a first electrical connection of the conducted electrical weapon, wherein the first electrical connection is associated with the first deployment connection. In various embodiments of the above method, the step of activating the first deployment connection may further comprise providing at least one of an ignition signal or a stimulus signal through the first electrical connection. In various embodiments of the above method, the step of activating the first deployment connection may further comprise deploying a first cartridge associated with the first deployment connection. In various embodiments of the above method, the step of activating the first deployment connection may further comprise providing a stimulus signal through the first cartridge.

In various embodiments, the above method may further comprise the step of activating the next deployment connection based on the deployment order. In various embodiments, the above method may further comprise the step of updating the deployment list to indicate a second next deployment connection of the plurality of deployment connections in the deployment order. In various embodiments of the above method, the step of activating the first deployment connection and the activating the next deployment connection are separate activation events. In various embodiments of the above method, the deployment order of the deployment list is sequentially maintained between the separate activation events. In various embodiments of the above method, the separate activation events are separated by a period of time including a reloading event.

In various embodiments, the above method may further comprise the steps of arming the conducted electrical weapon to enable deployments from the conducted electrical weapon; and generating the deployment list responsive to the arming.

In various embodiments of the above method, the first deployment connection may comprise at least one of a cartridge, a magazine bore, or an electrical connection.

In various embodiments, a conducted electrical weapon ("CEW"). The CEW may comprise a handle and a magazine. The handle may comprise a processing circuit; and a tangible, non-transitory memory configured to communicate with the processing circuit. The magazine may be coupled to the handle. A plurality of cartridges may be disposed within the magazine and electrically coupled to the handle. The tangible, non-transitory memory may comprise instructions stored thereon that, in response to execution by the processing circuit, cause the processing circuit to perform operations. The processing circuit may perform one or more operations. For example, the operations may comprise determining a deployment list, wherein the deployment list defines a deployment order for a plurality of deployment connections; activating a first deployment connection of the plurality of deployment connections based on the deployment order, wherein activating the first deployment connection causes a deployment of a first cartridge of the plurality of cartridges; and updating the deployment list to indicate a next deployment connection of the plurality of deployment connections in the deployment order.

In various embodiments of the above CEW, the step of determining the deployment list may comprise generating a random deployment list. In various embodiments of the above CEW, the step of determining the deployment list may comprise determining available deployment connections; and generating a random deployment list based on the available deployment connections. In various embodiments of the above CEW, the step of determining the deployment list may comprise generating a dynamic deployment list. Generating the dynamic deployment list may be based on at least one of deployment data, an operating setting, a user input, or an available connection. The deployment data may be associated with at least one of the handle, the magazine, or a cartridge from the plurality of cartridge. Generating the dynamic deployment list may be based on the operating setting, and wherein the operating setting is associated with at least one of the handle, the magazine, or a cartridge from the plurality of cartridges.

In various embodiments, the above CEW may further perform the operation of updating the deployment data based on the activating the first deployment connection.

In various embodiments, a method is disclosed. The method may include one or more steps. The steps may be executed, completed, and/or the like by a processing circuit, computing device, conducted electrical weapon, and/or the like. For example, the method may include steps during a first activation event comprising determining a deployment list, wherein the deployment list defines a deployment order for a plurality of deployment connections; activating a first deployment connection of the plurality of deployment connections based on the deployment order; and updating the deployment list to indicate a next deployment connection of the plurality of deployment connections in the deployment order. The method may include steps during a second activation event comprising determining the deployment list; activating the next deployment connection based on the deployment order; and updating the deployment list to indicate a second next deployment connection of the plurality of deployment connections in the deployment order.

In various embodiments of the above method, the first activation event may be separated by the second activation event by a period of time. The period of time may include at least one of a loading of a first cartridge or an unloading of a second cartridge. In various embodiments of the above method, the deployment list may be sequentially maintained between the first activation event and the second activation event. In various embodiments of the above method, the deployment list may be generated between the first activation event and the second activation event. In various embodiments of the above method, the step of determining the deployment list during each of the first activation event and the second activation event may comprise retrieving the deployment list, randomly generating the deployment list, or dynamically generating the deployment list.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method for distributing deployments in a conducted electrical weapon, the method comprising:

retrieving, by a processing circuit, a deployment list, wherein the deployment list defines a deployment order for a plurality of deployment connections for the conducted electrical weapon;

activating, by the processing circuit, a first deployment connection of the plurality of deployment connections based on the deployment order, wherein the activating the first deployment connection causes deployment of a first cartridge of the conducted electrical weapon; and updating, by the processing circuit, the deployment list to indicate a next deployment connection of the plurality of deployment connections in the deployment order.

2. The method of claim 1, wherein the activating the first deployment connection further comprises enabling, by the processing circuit, a first electrical connection of the conducted electrical weapon, wherein the first electrical connection is associated with the first deployment connection.

3. The method of claim 2, wherein the activating the first deployment connection further comprises providing, by the processing circuit, an ignition signal through the first electrical connection.

4. The method of claim 1, further comprising activating, by the processing circuit, the next deployment connection based on the deployment order, wherein the activating the next deployment connection causes deployment of a next cartridge of the conducted electrical weapon.

5. The method of claim 4, wherein the activating the first deployment connection and the activating the next deployment connection are separate activation events separated by a period of time.

6. The method of claim 5, wherein the deployment order of the deployment list is sequentially maintained between the separate activation events.

7. The method of claim 1, further comprising:

arming, by the processing circuit, the conducted electrical weapon to enable deployments from the conducted electrical weapon; and generating, by the processing circuit, the deployment list responsive to the arming.

8. A conducted electrical weapon, comprising:

a handle comprising:

a processing circuit; and a tangible, non-transitory memory configured to communicate with the processing circuit;

a magazine coupled to the handle; and a plurality of cartridges disposed within the magazine and electrically coupled to the handle, wherein the tangible, non-transitory memory comprises instructions stored thereon that, in response to execution by the processing circuit, cause the processing circuit to perform operations comprising:

determining a deployment list, wherein the deployment list defines a deployment order for a plurality of deployment connections;

activating a first deployment connection of the plurality of deployment connections based on the deployment order, wherein activating the first deployment connection causes a deployment of a first cartridge of the plurality of cartridges; and updating the deployment list to indicate a next deployment connection of the plurality of deployment connections in the deployment order.

9. The conducted electrical weapon of claim 8, wherein the determining the deployment list comprises generating a random deployment list.

10. The conducted electrical weapon of claim 8, wherein the determining the deployment list comprises:

determining available deployment connections; and generating the deployment list based on the available deployment connections.

11. The conducted electrical weapon of claim 8, wherein the determining the deployment list comprises generating a dynamic deployment list.

12. The conducted electrical weapon of claim 11, wherein the generating the dynamic deployment list is based on deployment data, and wherein the deployment data is associated with at least one of the handle, the magazine, or a cartridge of the plurality of cartridges.

13. The conducted electrical weapon of claim 12, wherein the operations further comprise updating the deployment data based on the activating the first deployment connection.

14. The conducted electrical weapon of claim 11, wherein the generating the dynamic deployment list is based on an operating setting, and wherein the operating setting is associated with at least one of the handle, the magazine, or a cartridge of the plurality of cartridges.

15. A method for distributing deployments in a conducted electrical weapon, the method comprising:

during a first activation event:

determining a deployment list, wherein the deployment list defines a deployment order for a plurality of deployment connections for the conducted electrical weapon;

activating a first deployment connection of the plurality of deployment connections based on the deployment order, wherein the activating the first deployment connection causes deployment of a first cartridge of the conducted electrical weapon; and updating the deployment list to indicate a next deployment connection of the plurality of deployment connections in the deployment order; and during a second activation event:

determining the deployment list;

activating the next deployment connection based on the deployment order, wherein the activating the next deployment connection causes deployment of a next cartridge of the conducted electrical weapon; and updating the deployment list to indicate a second next deployment connection of the plurality of deployment connections in the deployment order.

16. The method of claim 15, wherein the first activation event is separated by the second activation event by a period of time.

17. The method of claim 16, wherein the period of time includes at least one of a loading of the next cartridge or an unloading of the first cartridge.

18. The method of claim 15, wherein the deployment list is sequentially maintained between the first activation event and the second activation event.

19. The method of claim 15, wherein the deployment list is generated between the first activation event and the second activation event.

20. The method of claim 15, wherein the determining the deployment list during each of the first activation event and the second activation event comprises retrieving the deployment list, randomly generating the deployment list, or dynamically generating the deployment list.

* * * * *